US011585298B1

(12) United States Patent
Dudar et al.

(10) Patent No.: US 11,585,298 B1
(45) Date of Patent: Feb. 21, 2023

(54) CANISTER CAPACITY DIAGNOSTICS FOR EVAPORATIVE EMISSIONS CONTROL SYSTEM IN HEAVY DUTY VEHICLES

(71) Applicant: Ford Global Technologies, LLC, Dearborn, MI (US)

(72) Inventors: Aed Dudar, Canton, MI (US); Scott Bohr, Novi, MI (US); Matthew Werner, Kenockee Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/650,505

(22) Filed: Feb. 9, 2022

(51) Int. Cl.
*F02M 25/08* (2006.01)
*F02D 41/00* (2006.01)

(52) U.S. Cl.
CPC ..... *F02M 25/0809* (2013.01); *F02D 41/003* (2013.01); *F02M 25/0836* (2013.01); *F02M 25/0854* (2013.01)

(58) Field of Classification Search
CPC ..... F02M 25/0809; F02M 25/0836; F02D 41/003; F02D 41/0037
See application file for complete search history.

(56) References Cited

U.S. PATENT DOCUMENTS 5,056,494 A * 10/1991 Kayanuma ..... F02M 25/0872 123/519
5,632,252 A * 5/1997 Hyodo ..... F02D 41/0042 123/520
5,778,867 A * 7/1998 Osanai ..... F02D 41/004 123/698
9,790,898 B2 10/2017 Dudar
10,746,111 B1 * 8/2020 Dudar ..... F02D 41/22
10,830,189 B1 11/2020 Dudar
11,047,321 B2 6/2021 Dudar
11,104,222 B2 8/2021 Dudar
11,466,631 B2 * 10/2022 Viola ..... F02D 41/0077
2016/0341156 A1 * 11/2016 Yang ..... F02M 25/0809
2017/0314512 A1 * 11/2017 Dudar ..... F02M 25/0836
2020/0369508 A1 * 11/2020 Dudar ..... B60K 15/03504
2020/0370497 A1 * 11/2020 Dudar ..... B60K 15/03504
2022/0243687 A1 * 8/2022 Collet ..... B60K 15/03504

OTHER PUBLICATIONS

Dudar, A. et al., "Onboard Refueling Vapor Recovery for Heavy Duty Applications," U.S. Appl. No. 17/449,219, filed Sep. 28, 2021, 70 pages.

* cited by examiner

*Primary Examiner* — Sizo B Vilakazi
*Assistant Examiner* — Anthony L Bacon
(74) *Attorney, Agent, or Firm* — Vincent Mastrogiacomo; McCoy Russell LLP

(57) ABSTRACT

Methods and systems are provided for an evaporative emissions control system for onboard refueling vapor recovery of a heavy duty vehicle. In one example, a method may include, in response to greater than a threshold change in a fuel level of a fuel tank fluidically coupled to at least two fuel vapor storage canisters of an evaporative emissions control system during a refueling event, performing a canister working capacity diagnostic on each of the at least two fuel vapor storage canisters by measuring an exhaust gas air-fuel ratio (AFR) while independently purging each of the at least two fuel vapor storage canisters. In this way, the working capacity of each fuel vapor storage canister may be separately assessed in order to more accurate identify degradation of the working capacity.

20 Claims, 6 Drawing Sheets

CANISTER CAPACITY DIAGNOSTICS FOR EVAPORATIVE EMISSIONS CONTROL SYSTEM IN HEAVY DUTY VEHICLES

FIELD

The present description relates generally to methods and systems for an evaporative emissions control system of a vehicle.

BACKGROUND/SUMMARY

Vehicle emission control systems may be configured to store fuel vapors from fuel tank refueling, diurnal emissions, and running loss vapors and then purge the stored vapors during a subsequent engine operation. Specifically, the fuel vapors (e.g., vaporized hydrocarbons) are stored in a fuel vapor storage canister, also referred to herein as a "canister," that is packed with an adsorbent (e.g., activated carbon) that adsorbs and stores the vapors until they are routed to an engine intake manifold for use as fuel. In a hybrid vehicle, the fuel vapors stored in the canister are primarily refueling vapors.

Two different types of systems are typically used for recovery of refueling vapors: onboard refueling vapor recovery (ORVR) system and off-board refueling vapor recovery (e.g., non-ORVR) systems. Examples of conventional vehicles using non-ORVR systems may include heavy duty vehicles weighing over 8500 pounds. In a vehicle using a non-ORVR system, refueling vapors may be recovered by gas station infrastructure, such as an underground recovery tank. The gas station infrastructure may include refueling nozzles with boots that seal around a filler neck for off-board recovery. However, some gas station infrastructures may not include refueling nozzles configured for off-board recovery, and so fuel vapors may escape to atmosphere.

As such, it may be desirable to transition heavy duty vehicles to using ORVR systems in order to reduce refueling emissions. Typically, a size of a fuel vapor storage canister is proportional to a size of a fuel tank. However, incorporating a large canister in vehicles including large (e.g., 80 gallon) fuel tanks may pose challenges during vehicle refueling. For example, large canisters may restrict vapor flow in the canister, producing system back pressure from the canister as fuel vapors from refueling are loaded into the canister. A back pressure of 10 inH2O may shut off a refueling pump, resulting in slow or incomplete refueling. Therefore, multiple smaller canisters may be arranged in parallel to provide a refueling vapor capacity for large fuel tanks while reducing canister restriction.

However, canisters age over time and/or may become contaminated (e.g., via water ingestion, liquid fuel carry-over, or carbon pellet breakdown). As a result, the adsorbent may become degraded and no longer adsorb or desorb fuel vapor. Without a method to individually test a working capacity of each canister, it may be difficult to identify when one canister in a parallel configuration is not adsorbing and desorbing fuel vapors as intended. Further, operating with a degraded canister may increase evaporative emissions.

In one example, the issues described above may be addressed by a method, comprising, in response to greater than a threshold change in a fuel level of a fuel tank fluidically coupled to at least two fuel vapor storage canisters of an evaporative emissions control system during a refueling event, performing a canister working capacity diagnostic on each of the at least two fuel vapor storage canisters by measuring an exhaust gas air-fuel ratio (AFR) while independently purging each of the at least two fuel vapor storage canisters. In this way, the working capacity of each fuel vapor storage canister may be separately assessed in order to more accurate identify degradation of the working capacity of individual canisters.

As one example, one of the at least two fuel vapor storage canisters may be selected to be assessed via the canister working capacity diagnostic at a time. The selected fuel vapor storage canister may be independently purged by opening or maintaining open a first canister vent valve (CVV) coupled between a first vent port of the selected fuel vapor storage canisters and a vent line, closing or maintaining closed a CVV coupled between a vent port of each of the at least two fuel vapor storage canisters that is not the selected fuel vapor storage canister and the vent line. For example, closing or maintaining closed the CVV coupled between the vent port of each of the at least two fuel vapor storage canisters that is not the selected fuel vapor storage canister may prevent vapor flow across each of the at least two fuel vapor storage canisters that is not the selected fuel vapor storage canister. Further, a balance valve that is coupled between the fuel tank and a branched loading passage coupling the fuel tank to each of the at least two fuel vapor storage canisters may be adjusted to a first position where the fuel tank is fluidically coupled to the selected fuel vapor storage canister and not fluidically coupled to each of the at least two fuel vapor storage canisters that is not the selected fuel vapor storage canister. The independent purging of the selected fuel vapor storage canister may be initiated by opening a canister purge valve (CPV) positioned in a branched purge passage that fluidically couples an engine intake to a purge port of each of the at least two fuel vapor storage canisters.

As another example, degradation of the working capacity of the selected fuel vapor storage canister may be indicated in response to the exhaust gas AFR shifting lean upon opening the CPV, whereas the working capacity may be determined in proportion to a magnitude of the exhaust gas AFR in response to the exhaust gas AFR shifting rich upon opening the CPV. Further, the selected fuel vapor storage canister may be sealed to prevent vapor flow across the selected fuel vapor storage canister in response to the degradation of the working capacity being indicated. For example, the first CVV may be maintained closed, and the balance valve may not be adjusted to a position that fluidically couples the selected fuel vapor storage canister to the fuel tank. Further still, a refueling capacity of the fuel tank may be reduced for subsequent refueling events in response to the degradation of the working capacity being indicated.

In this way, the working capacity of each of a plurality of parallel fuel vapor storage canisters may be separately diagnosed by separately purging a canister following a refueling event that is expected to fully load each canister. As a result, exhaust gas AFR measurements may indicate the working capacity of only the fuel vapor storage canister being purged, and so fuel vapors stored in other fuel vapor storage canisters may not confound the measurements. By accurately identifying a degraded fuel vapor storage canister and preventing the degraded fuel vapor storage canister from being used, vehicle evaporate emissions may be decreased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
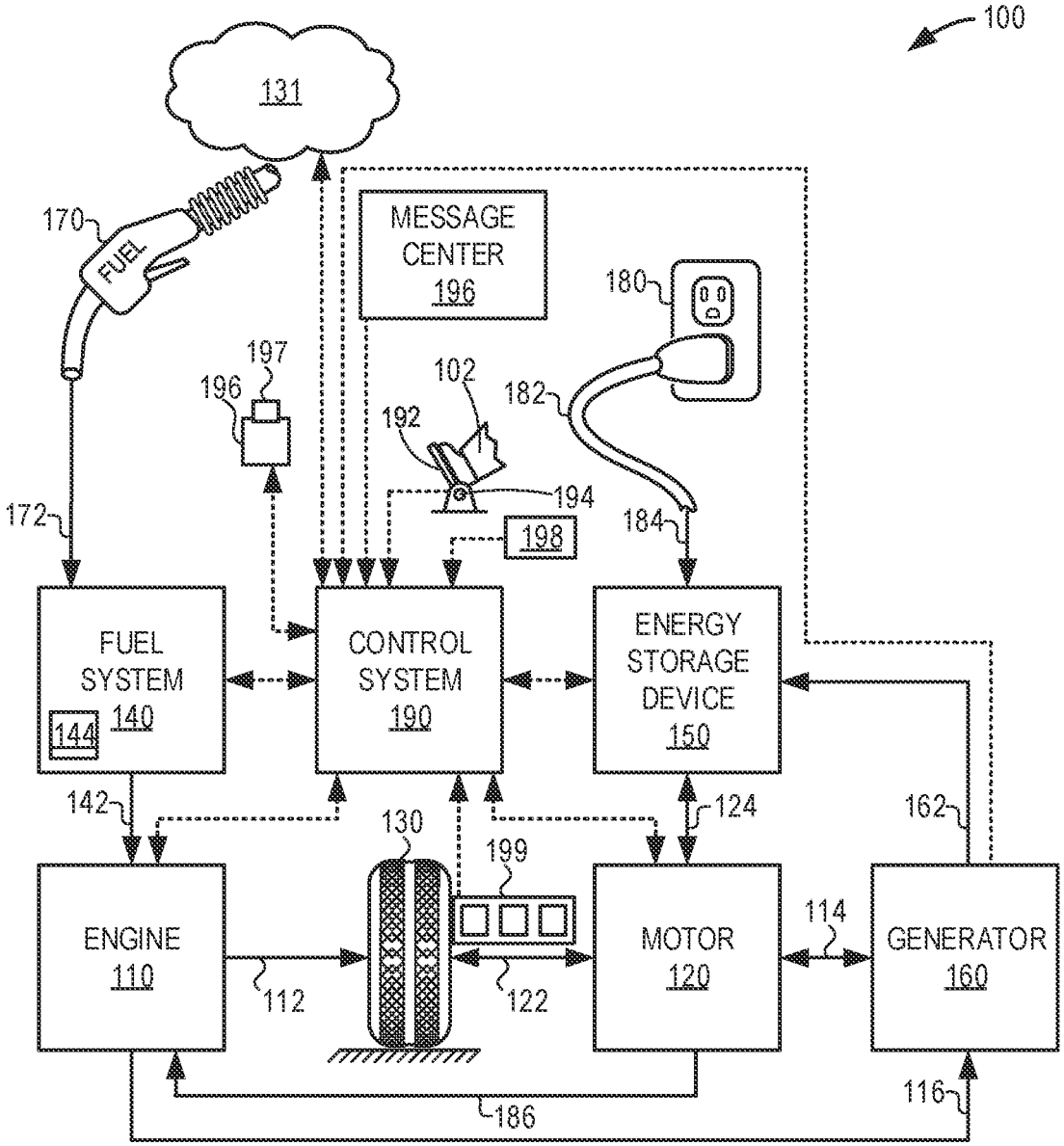
FIG. 1 shows a high-level block diagram illustrating an example vehicle propulsion system.
Figure 2:
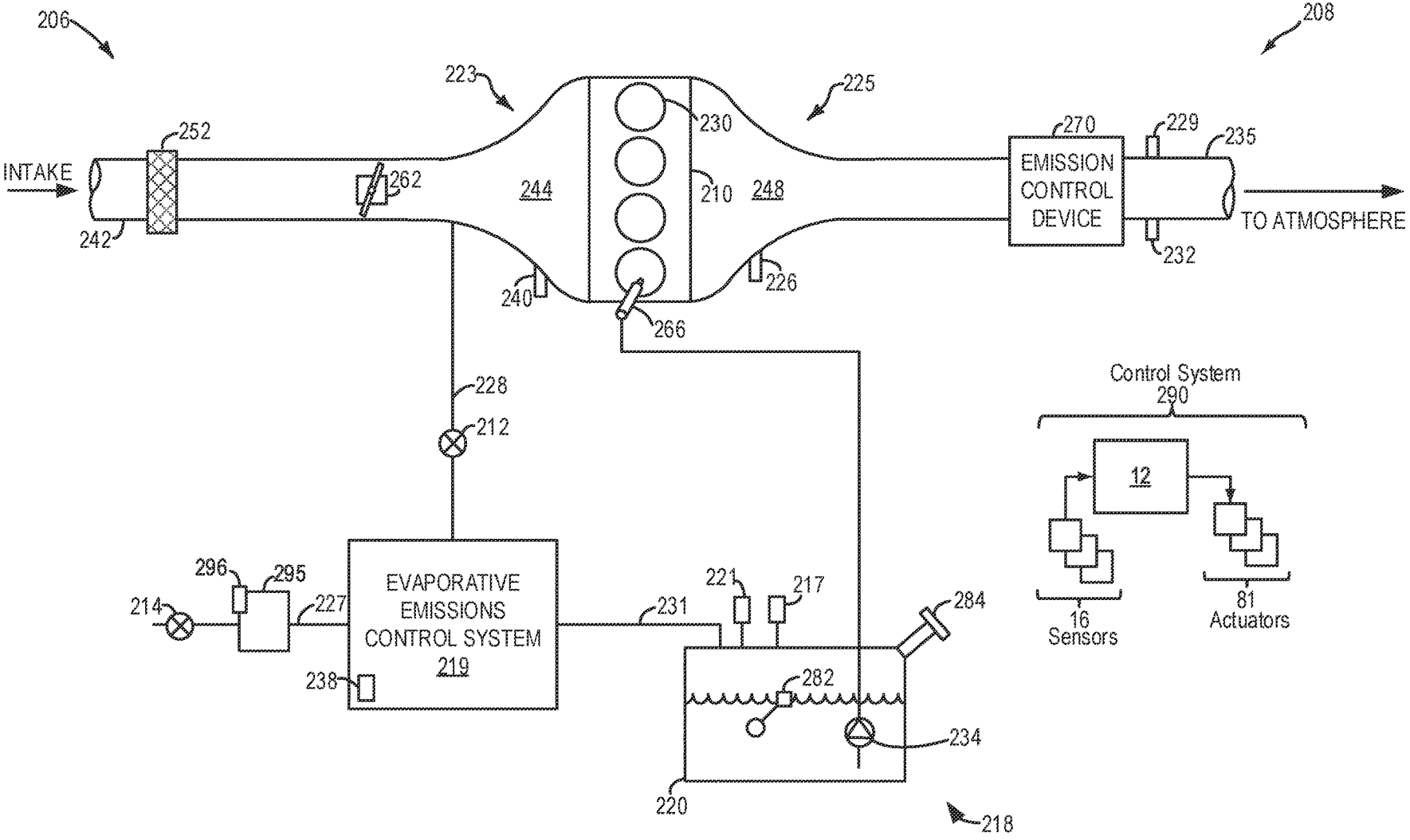
FIG. 2 shows an example engine system, fuel system, and evaporative emissions control system included in the example vehicle system of FIG. 1.
Figure 5A:
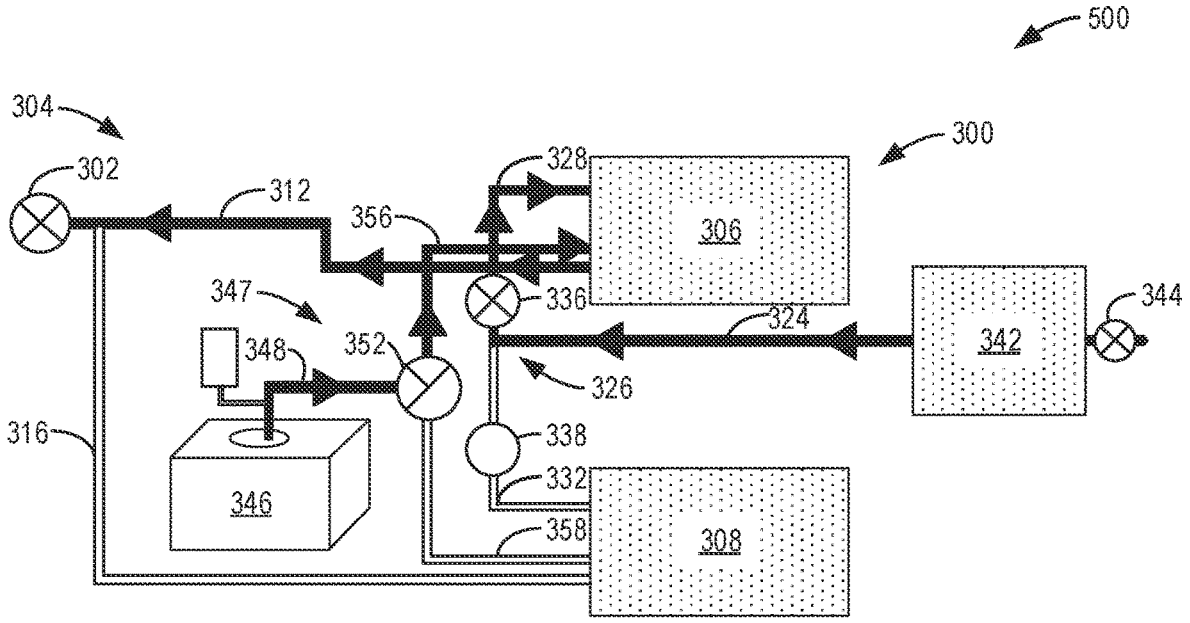
FIGS. 5A and 5B illustrate flow paths through the evaporative emissions control system of FIG. 3 during isolated purging of each fuel parallel fuel vapor storage canister.
Figure 5B:
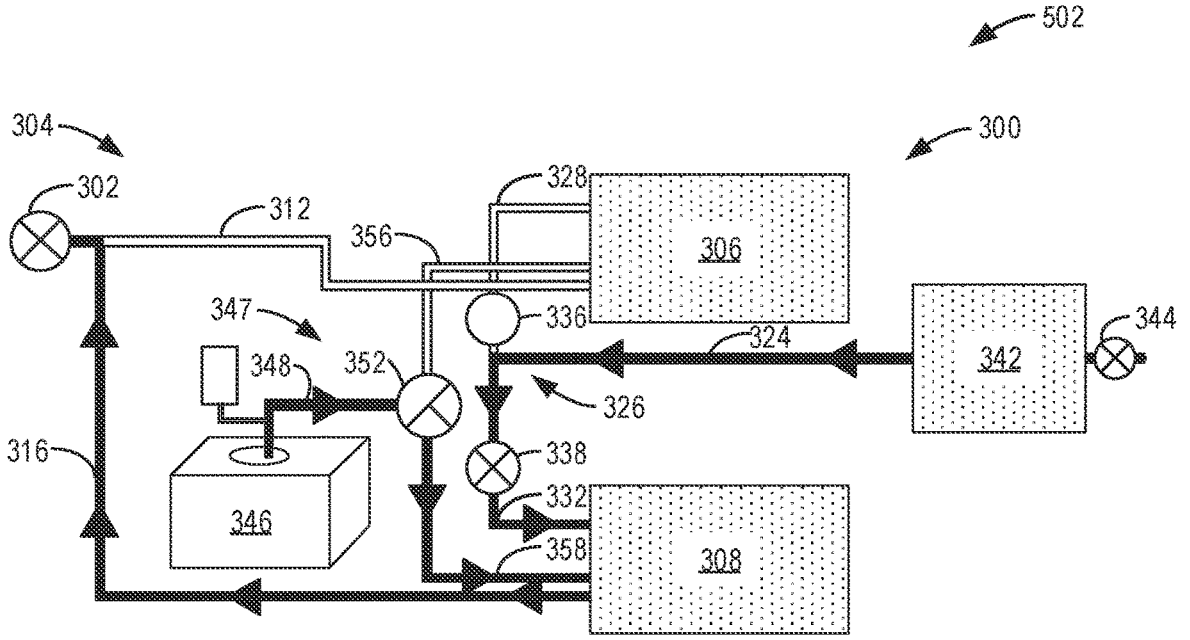
Figure 6:
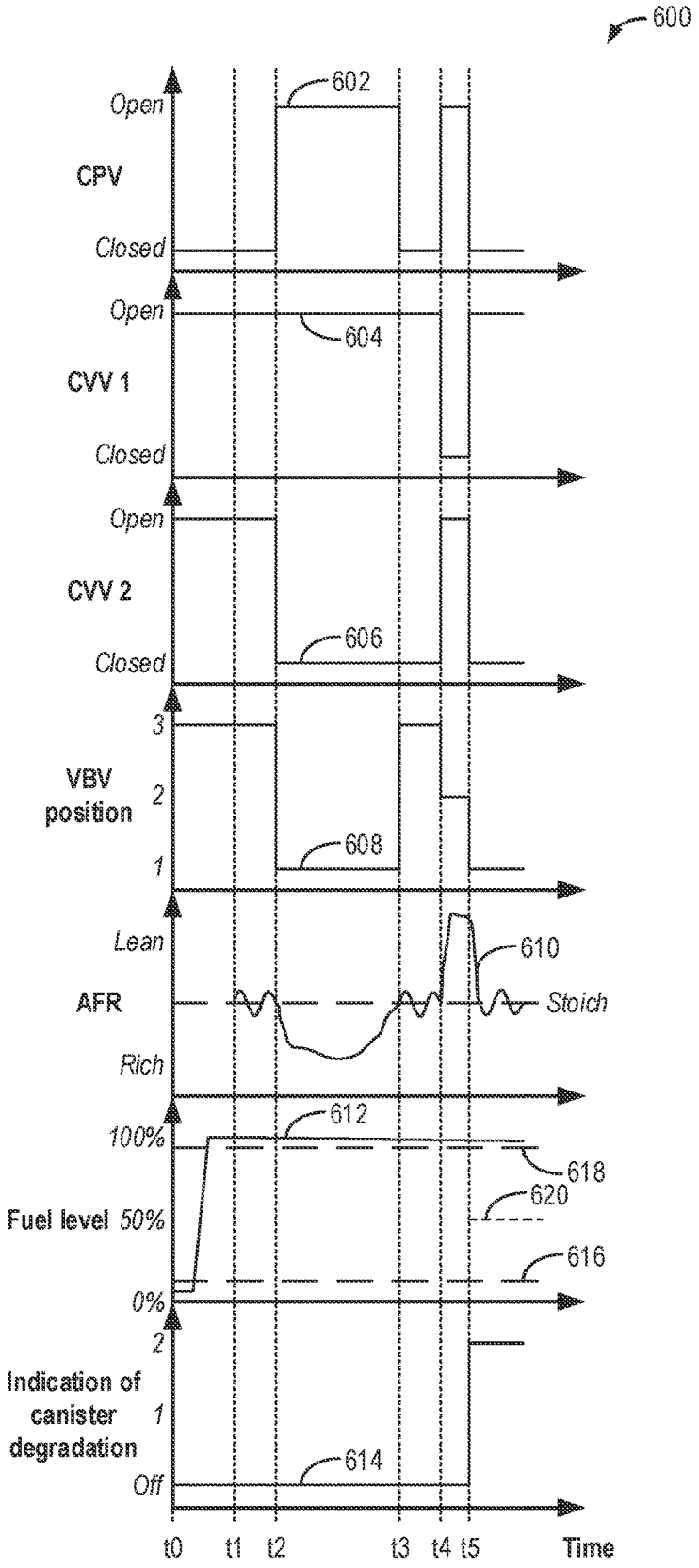
FIG. 6 shows a prophetic example timeline for evaporative emissions control system adjustments while diagnosing a working capacity of parallel fuel vapor storage canisters.

The following description relates to systems and methods for onboard refueling vapor recovery (ORVR) in heavy duty vehicles. The vehicle may be a hybrid vehicle, an example of which is shown in FIG. 1, and may include a fuel burning engine and a motor. The engine may be coupled to a fuel system and an evaporative emissions control system, as shown in FIG. 2, which may recover fuel vapors from the fuel tank and may store the captured fuel vapors in a fuel vapor storage canister. The stored fuel vapors may be purged into an intake of the engine to be used as fuel. The evaporative emissions control system may have the configuration shown in FIG. 3, including two fuel vapor storage canisters arranged in parallel. A working capacity of each fuel vapor storage canister to store fuel vapors may be diagnosed according to the method of FIG. 4. For example, each of the fuel vapor storage canisters may be assessed by purging each fuel vapor storage canister in isolation following a refueling event and measuring a resulting change in an exhaust gas air-fuel ratio. Valve positions of the evaporative emissions control system that may enable the isolated purging of each fuel vapor storage canister are shown in FIGS. 5A and 5B. Further, an example timeline for adjusting the valves of the evaporative emissions control system to perform the working capacity diagnostic on each fuel vapor storage canister is shown in FIG. 6.

Turning now to the figures, FIG. 1 illustrates an example vehicle system 100. Vehicle system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle propelled with vehicle system 100 may be referred to as a hybrid electric vehicle (HEV).

Vehicle system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via a drive wheel 130, as indicated by an arrow 122, while engine 110 is deactivated.

During other operating conditions, engine 110 may be set to a deactivated state (as described above) while motor 120 may be operated to charge an energy storage device 150. For example, motor 120 may receive wheel torque from drive wheel 130, as indicated by arrow 122, and may convert the kinetic energy of the vehicle to electrical energy for storage at energy storage device 150, as indicated by an arrow 124. This operation may be referred to as regenerative braking of the vehicle. Thus, motor 120 may function as a generator in some examples. However, in other examples, a generator 160 may instead receive wheel torque from drive wheel 130 and may convert the kinetic energy of the vehicle to electrical energy for storage at energy storage device 150, as indicated by an arrow 162. As an additional example, motor 120 may use energy stored at energy storage device 150 to crank engine 110 in a starting operation, as indicated by an arrow 186.

During still other operating conditions, engine 110 may be operated by combusting fuel received from a fuel system 140, as indicated by an arrow 142. For example, engine 110 may be operated to propel the vehicle via drive wheel 130, as indicated by an arrow 112, while motor 120 is deactivated. During other operating conditions, both engine 110 and motor 120 may each be operated to propel the vehicle via drive wheel 130, as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle system 100 may be configured as a series type vehicle propulsion system, whereby the engine does not directly propel the drive wheels. Rather, engine 110 may be operated to power motor 120, which may in turn propel the vehicle via drive wheel 130, as indicated by arrow 122. For example, during select operating conditions, engine 110 may drive generator 160, as indicated by an arrow 116, which may in turn supply electrical energy to one or more of motor 120, as indicated by an arrow 114, or energy storage device 150, as indicated by arrow 162. As another example, engine 110 may be operated to drive motor 120, which may in turn function as a generator to convert the engine output to electrical energy. The electrical energy may be stored at energy storage device 150 for later use by the motor, for example.

Fuel system 140 may include one or more fuel storage tanks 144 for storing fuel on-board the vehicle. For example, fuel tank 144 may store one or more liquid fuels, including (but not limited to) gasoline, diesel, and alcohol fuels. In some examples, the fuel may be stored on-board the vehicle as a blend of two or more different fuels. For example, fuel tank 144 may be configured to store a blend of gasoline and ethanol (such as E10, E85, etc.) or a blend of gasoline and methanol (such as M10, M85, etc.), whereby these fuels or fuel blends may be delivered to engine 110 as indicated by arrow 142. Still other suitable fuels or fuel blends may be supplied to engine 110, where they may be combusted to produce an engine output (e.g., torque). The engine output may be utilized to propel the vehicle (as indicated by arrow 112) or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

A control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback.

Control system 190 may receive an indication of an operator requested output of the vehicle propulsion system from a vehicle operator 102. For example, control system 190 may receive sensory feedback from a pedal position sensor 194 concerning a position of a pedal 192. Pedal 192 may refer schematically to a brake pedal and/or an accelerator pedal that may be depressed by vehicle operator 102.

Energy storage device 150 may periodically receive electrical energy from a power source 180 residing external to the vehicle (e.g., an external stationary power grid that is not part of the vehicle), as indicated by an arrow 184. As a non-limiting example, vehicle system 100 may be configured as a plug-in HEV, whereby electrical energy may be supplied to energy storage device 150 from power source 180 via an electrical energy transmission cable 182. During a recharging operation of energy storage device 150 from power source 180, electrical energy transmission cable 182 may electrically couple energy storage device 150 and power source 180. While the vehicle propulsion system is operated to propel the vehicle, electrical energy transmission cable 182 may be disconnected between power source 180 and energy storage device 150. Control system 190 may identify and/or control the amount of electrical energy stored at the energy storage device, which may be referred to as the state of charge (SOC).

In other examples, electrical energy transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle system 100 may be refueled by receiving fuel via a fuel dispensing device 170, as indicated by an arrow 172. In some examples, fuel tank 144 may be configured to store the fuel received from fuel dispensing device 170 until it is supplied to engine 110 for combustion. In some examples, control system 190 may receive an indication of the level of fuel stored in fuel tank 144 via a fuel level sensor. The level of fuel stored in fuel tank 144 (e.g., as identified by the fuel level sensor) may be communicated to the vehicle operator, for example, via a fuel gauge or indication in a vehicle instrument panel (e.g., message center) 196. Further, fuel vapors generated during refueling fuel tank 144 may be stored in one or more fuel vapor storage canisters, as will be further described below with respect to FIGS. 2 and 3.

The vehicle system 100 may also include an ambient temperature/humidity sensor 198 and a roll stability control sensor, such as a lateral and/or longitudinal and/or yaw rate sensor(s) 199. Vehicle instrument panel 196 may include indicator light(s) and/or a text-based display in which messages are displayed to an operator. Vehicle instrument panel 196 may also include various input devices for receiving an operator input, such as buttons, touch screens, voice input/recognition, etc. For example, vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle (e.g., fuel tank 144) may be depressurized so that refueling may be performed.

Control system 190 may be communicatively coupled to other vehicles or infrastructures using appropriate communications technology, as is known in the art. For example, control system 190 may be coupled to other vehicles or infrastructures via a wireless network 131, which may comprise Wi-Fi, Bluetooth, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. Information exchanged between vehicles can be either directly communicated between vehicles or can be multi-hop. In some examples, longer range communications (e.g. WiMax) may be used in place of or in conjunction with V2V or V2I2V to extend the coverage area by a few miles. In still other examples, vehicle control system 190 may be communicatively coupled to other vehicles or infrastructures via wireless network 131 and the internet (e.g. the cloud), as is commonly known in the art.

FIG. 2 shows a schematic depiction of a vehicle system 206. It may be understood that vehicle system 206 may comprise the same vehicle system as vehicle system 100 depicted in FIG. 1. Vehicle system 206 may derive propulsion power from engine system 208 and/or an on-board energy storage device (such as energy storage device 150 shown in FIG. 1). An energy conversion device, such as a generator (e.g., generator 160 of FIG. 1), may be operated to absorb energy from vehicle motion and/or engine operation and convert the absorbed energy to an energy form suitable for storage by the energy storage device.

Engine system 208 may include an engine 210 having a plurality of cylinders 230. Engine 210 may be engine 110 shown in FIG. 1, for example. Engine 210 may include an engine intake system 223 and an engine exhaust system 225. Engine intake system 223 may include an air intake throttle 262 fluidly coupled to an engine intake manifold 244 via an intake passage 242. Air may be routed to intake throttle 262 after passing through an air filter 252 coupled to intake passage 242 upstream of intake throttle 262. Engine exhaust system 225 includes an exhaust manifold 248 leading to an exhaust passage 235 that routes exhaust gas to the atmosphere. Engine exhaust system 225 may include one or more emission control devices 270 mounted in a close-coupled position. The one or more emission control devices may include a three-way catalyst, a lean NOx trap, a particulate filter (e.g., a diesel particulate filter or a gasoline particulate filter), an oxidation catalyst, and so on. It will be appreciated that other components may be included in the engine, such as a variety of valves and sensors, as further elaborated in herein. In examples where engine system 208 is a boosted engine system, the engine system may further include a boosting device, such as a turbocharger (not shown).

Engine system 208 is coupled to a fuel system 218 and an evaporative emissions control system 219. Fuel system 218 includes a fuel tank 220 coupled to a fuel pump 234, the fuel tank supplying a fuel to engine 210 that propels vehicle system 206. Evaporative emissions control system 219 includes a plurality of fuel vapor storage canisters. An example of the arrangement of the plurality of fuel vapor storage canisters in evaporative emissions control system 219 will be described below with respect to FIG. 3. During a fuel tank refueling event, fuel may be pumped into the vehicle from an external source through a refueling port 284. Fuel tank 220 may hold a plurality of fuel blends, including fuel with a range of alcohol concentrations, such as various gasoline-ethanol blends, including E10, E85, gasoline, etc., and combinations thereof. A fuel level sensor 282 located in fuel tank 220 may provide an indication of a fuel level (e.g., "fuel level input") to a controller 12 of a control system 290 (which may be control system 190 of FIG. 1, for example). As depicted, fuel level sensor 282 may comprise a float connected to a variable resistor. Alternatively, other types of fuel level sensors may be used.

Fuel pump 234 is configured to deliver pressurized fuel to fuel injectors of engine 210, such as an example fuel injector 266. While only a single fuel injector 266 is shown, additional fuel injectors may be provided for each cylinder. It will be appreciated that fuel system 218 may be a return-less fuel system, a return fuel system, or various other types of fuel system. Vapors generated in fuel tank 220 may be routed to evaporative emissions control system 219 via a conduit 231 for storage before being purged to the engine intake system 223.

When purging conditions are met, such as when at least one fuel vapor storage canister is saturated, vapors stored in the at least one fuel vapor storage canister may be purged to engine intake system 223 by opening a canister purge valve (CPV) 212 positioned in a purge line 228. CPV 212 may be a normally closed valve (e.g., closed when de-energized), for example. In one example, canister purge valve 212 may be a solenoid valve wherein opening or closing of the valve is performed via actuation of a canister purge solenoid.

Evaporative emissions control system 219 further includes a vent 227 for routing gases to the atmosphere when storing fuel vapors from fuel tank 220. Vent 227 may also allow fresh air to be drawn into evaporative emissions control system 219 when purging stored fuel vapors to engine intake 223 via purge line 228 and CPV 212 (e.g., when CPV 212 is open). While this example shows vent 227 communicating with fresh, unheated air, various modifications may also be used. Vent 227 may include a canister vent valve (CVV) 214 to adjust a flow of air and vapors between evaporative emissions control system 219 and the atmosphere. When included, CVV 214 may be a normally open valve (e.g., open when de-energized) so that air, stripped of fuel vapor after having passed through the fuel vapor storage canisters, can be pushed out to the atmosphere (for example, during refueling while the engine is off). Likewise, during purging operations (for example, during fuel vapor storage canister regeneration and while the engine is running), CVV 214 may be opened to allow a flow of fresh air to strip the fuel vapors stored in the fuel vapor storage canister(s). In one example, CVV 214 may be a solenoid valve wherein opening or closing of the valve is performed via actuation of a canister vent solenoid. In particular, the canister vent valve may be in an open position that is closed upon actuation of the canister vent solenoid.

One or more pressure sensors may be coupled to fuel system 218 and evaporative emissions control system 219 for providing an estimate of a fuel system and an evaporative emissions system pressure, respectively. In the example illustrated in FIG. 2, a first pressure sensor 217 is coupled directly to fuel tank 220, and a second pressure sensor 238 is coupled within evaporative emissions control system 219. For example, first pressure sensor 217 may be a fuel tank pressure transducer (FTPT) coupled to fuel tank 220 for measuring a pressure of fuel system 218, and second pressure sensor 238 may measure a pressure of evaporative emissions control system 219. In alternative embodiments, a single pressure sensor may be included for measuring both the fuel system pressure and the evaporative system pressure. In some examples, engine control system 290 may infer and indicate undesired evaporative emissions (e.g., undesired hydrocarbon emissions) based on changes in an evaporative emissions system pressure during an emissions test.

One or more temperature sensors 221 may also be coupled to fuel system 218 for providing an estimate of a fuel system temperature. In one example, the fuel system temperature is a fuel tank temperature, wherein temperature sensor 221 is a fuel tank temperature sensor coupled to fuel tank 220. While the depicted example shows temperature sensor 221 directly coupled to fuel tank 220, in alternative embodiments, temperature sensor 221 may be coupled between fuel tank 220 and evaporative emissions control system 219.

Fuel vapors released from fuel vapor storage canisters of evaporative emissions control system 219, such as during a purging operation, may be directed into engine intake manifold 244 via purge line 228. The flow of vapors along purge line 228 may be regulated by CPV 212, coupled between evaporative emissions control system 219 and engine intake manifold 244. The quantity and rate of vapors purged to engine intake manifold 244 may be determined by the duty cycle of an associated canister purge valve solenoid (not shown). As such, the duty cycle of the canister purge valve solenoid may be determined by controller 12 based on engine operating conditions, including, for example, engine speed-load conditions, an air-fuel ratio, a fuel vapor storage canister load, etc. By commanding CPV 212 to be closed, the controller may seal evaporative emissions control system 219 from engine intake manifold 244. An optional canister check valve (not shown) may be included in purge line 228 to prevent pressure in engine intake manifold 244 from flowing gases in the opposite direction of the purge flow. As such, the check valve may be utilized if the canister purge valve control is not accurately timed or the canister purge valve itself can be forced open by a high intake manifold pressure. An estimate of the manifold absolute pressure (MAP) or manifold vacuum may be obtained by controller 12 from a MAP sensor 240 coupled to engine intake manifold 244. Alternatively, MAP may be inferred from alternate engine operating conditions, such as mass air flow (MAF), as measured by a MAF sensor (not shown) coupled to the intake manifold.

Fuel system 218 and evaporative emissions control system 219 may be operated by controller 12 in a plurality of modes by selective adjustment of the various valves and solenoids. For example, the fuel system and evaporative emissions system may be operated in a refueling mode (e.g., when fuel tank refueling is requested by a vehicle operator), wherein the controller 12 maintains CPV 212 closed and maintains CVV 214 open. Additional details regarding refueling will be provided herein with respect to FIGS. 3 and 4. By maintaining CPV 212 closed, refueling vapors are directed into the fuel vapor storage canisters of evaporative emissions control system 219 while preventing the fuel vapors from flowing into engine intake manifold 244. As another example, fuel system 218 and evaporative emissions control system 219 may be operated in a fuel vapor storage canister purging mode (e.g., after an emission control device light-off temperature has been attained and with the engine running), wherein the controller 12 may open CPV 212 while maintaining CVV 214 open. The vacuum generated by the intake manifold of the engine may be used to draw fresh air through evaporative emissions control system 219 via vent 227 to purge the stored fuel vapors into engine intake manifold 244. In this mode, the purged fuel vapors from the fuel vapor storage canisters are combusted in the engine. The purging may be continued until the stored fuel vapor amount in the fuel vapor storage canisters is below a threshold.

During purging, the learned vapor amount/concentration may be used to determine the amount of fuel vapors stored in the fuel vapor storage canister, and then during a later portion of the purging operation (when the fuel vapor storage canister is sufficiently purged or empty), the learned vapor amount/concentration may be used to estimate a loading state of the fuel vapor storage canister. For example, one or more oxygen sensors may be coupled to the fuel vapor storage canisters (e.g., downstream of the fuel vapor storage canisters) or positioned in the engine intake and/or engine exhaust to provide an estimate of a fuel vapor storage canister load (that is, an amount of fuel vapors stored in the fuel vapor storage canister). In the example illustrated in FIG. 2, an exhaust gas oxygen sensor 226 is coupled to exhaust manifold 248. The exhaust gas oxygen sensor 226 may be a universal exhaust gas oxygen (UEGO) sensor, a heated exhaust gas oxygen sensor (HEGO), or the like. Based on the fuel vapor storage canister load and further based on engine operating conditions, such as engine speed-load conditions, a purge flow rate may be determined. Further, a working capacity of each fuel vapor storage canister may be determined, as will be elaborated herein with respect to FIG. 4.

Vehicle system 206 may further include control system 290. Control system 290 is shown receiving information from a plurality of sensors 16 (various examples of which are described herein) and sending control signals to a plurality of actuators 81 (various examples of which are described herein). As one example, sensors 16 may include exhaust gas oxygen sensor 226 located upstream of emission control device 270, a temperature sensor 232 coupled to exhaust passage 235, MAP sensor 240, FTPT 217, second pressure sensor 238, temperature sensor 221, and a pressure sensor 229 located downstream of emission control device 270. Other sensors, such as additional pressure, temperature, air-fuel ratio, and composition sensors, may be coupled to various locations in the vehicle system 206. As another example, actuators 81 may include fuel injector 266, CPV 212, fuel pump 234, and air intake throttle 262.

As described above with reference to FIG. 1, control system 290 may further receive information regarding the location of the vehicle from an on-board GPS. Information received from the GPS may include vehicle speed, vehicle altitude, vehicle position, and so on. This information may be used to infer engine operating parameters, such as local barometric pressure. Control system 290 may further be configured to receive information via the internet or other communication networks. Information received from the GPS may be cross-referenced to information available via the internet to determine local weather conditions, local vehicle regulations, etc. Control system 290 may use the internet to obtain updated software modules, which may be stored in non-transitory memory.

Controller 12 of control system 290 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may receive input data from the various sensors, process the input data, and trigger the actuators in response to the processed input data based on instruction or code programmed therein corresponding to one or more routines. The controller 12 receives signals from the various sensors of FIGS. 1-2 and employs the various actuators of FIGS. 1-2 to adjust engine operation based on the received signals and instructions stored on a memory of the controller. An example control routine is described herein with regard to FIG. 4.

Controller 12 may also be configured to intermittently perform evaporative emissions system diagnostic routines to determine the presence or absence of undesired evaporative emissions in evaporative emissions system and/or fuel system. As such, undesired evaporative emission detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, undesired evaporative emission detection routines may be performed while the engine is running by operating a vacuum pump and/or using engine intake manifold vacuum.

Undesired evaporative emission tests may be performed by an evaporative leak check module (ELCM) 295 communicatively coupled to controller 12. ELCM 295 may be coupled in vent 227, between the fuel vapor storage canisters and CVV 214. ELCM 295 may include a vacuum pump configured to apply a negative pressure to the fuel system when in a first conformation, such as when administering a leak test. ELCM 295 may further include a reference orifice and a pressure sensor 296. Following the application of vacuum to fuel system 218 and evaporative emissions control system 219, a change in pressure at the reference orifice (e.g., an absolute change or a rate of change) may be monitored and compared to a threshold. Based on the comparison, undesired evaporative emissions from fuel system 218 and/or evaporative emissions control system 219 may be identified. The ELCM vacuum pump may be a reversible vacuum pump, and thus configured to apply a positive pressure to fuel system 218 and evaporative emissions control system 219 when a bridging circuit is reversed, placing the pump in a second conformation.

Figure 3:
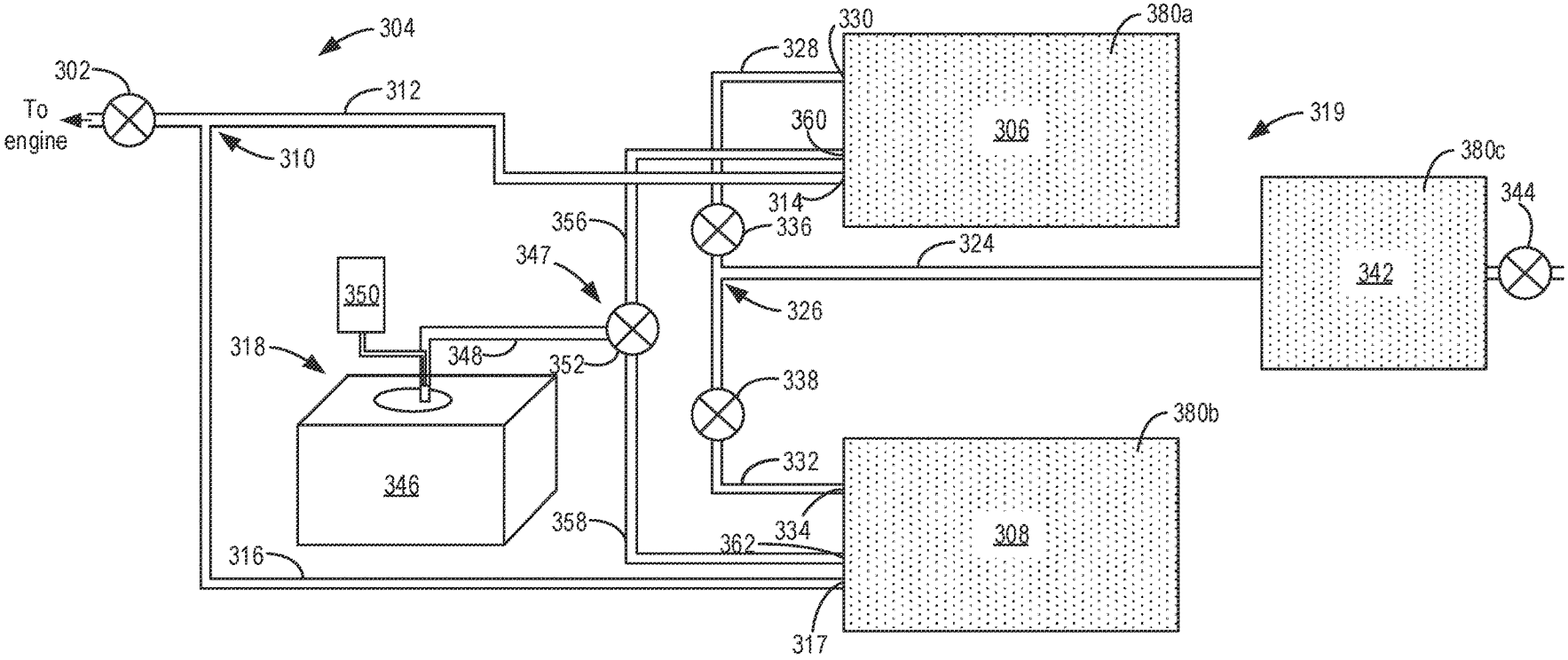
FIG. 3 shows an exemplary evaporative emissions control system configuration that includes two parallel fuel vapor storage canisters.

In various embodiments, a plurality of symmetric (e.g., same volumetric capacity) fuel vapor storage canisters may be arranged in parallel along a loading and unloading flow direction so that a total volume of fuel vapors may be divided and captured by the plurality of canisters. Accordingly, FIG. 3 shows an example evaporative emissions control and fuel system 300 including an evaporative emissions control system 319 and a fuel system 318. In the example shown, evaporative emissions control system 319 includes two parallel fuel vapor storage canisters and is one example of evaporative emissions control system 219 of FIG. 2. Similarly, fuel system 318 is one example of fuel system 218 of FIG. 2. Evaporative emissions control system 319 may be coupled to an intake manifold, such as engine intake manifold 244 of FIG. 2, via a canister purge valve (CPV) 302, which may be equivalent to CPV 212 of FIG. 2. The CPV 302 may be positioned on a purge line 304, which selectively couples each of a first fuel vapor storage canister 306 and a second fuel vapor storage canister 308 to the intake manifold via CPV 302 when CPV 302 is open. The fuel vapor storage canisters may be also referred to as "canisters" herein. In one example, first fuel vapor storage canister 306 and second fuel vapor storage canister 308 are symmetric and may each have a same volumetric capacity. For example, the volumetric capacity may be 2.8 L with a 29×100 millimeter (mm) bleed.

First fuel vapor storage canister 306 and second fuel vapor storage canister 308 are arranged in evaporative emissions control and fuel system 300 in a parallel loading flow direction and unloading flow direction. For example, purge line 304 is bifurcated at a first node 310 into a first purge branch 312 and a second purge branch 316. First purge branch 312 is coupled to first canister 306 at a first purge port 314, whereas second purge branch 316 is coupled to second canister 308 at a second purge port 317. First fuel vapor storage canister 306 and second fuel vapor storage canister 308 are further coupled to a vent line 324 that is bifurcated at a second node 326 into a first vent branch 328 and a second vent branch 332. First vent branch 328 is coupled to first canister 306 at a first vent port 330, and second vent branch 332 is coupled to second canister 308 at a second vent port 334. In some examples, evaporative emissions control system 319 may be configured with a bleed canister 342 coupled within vent line 324. Bleed canister 342 may be smaller than first canister 306 and second canister 308 (e.g., 35×100 mm). Hydrocarbons (e.g., fuel vapors) that desorb from first canister 306 and second canister 308 may be adsorbed within bleed canister 342.

Each of first canister 306, second canister 308, and bleed canister 342 is filled with an appropriate adsorbent for temporarily trapping fuel vapors (including vaporized hydrocarbons) generated during fuel tank refueling operations, diurnal vapors, and running-loss vapors. In the example shown, first canister 306 includes a first adsorbent 380*a*, second canister 308 includes a second adsorbent 380*b*, and bleed canister 342 includes a third adsorbent 380*c*. Each of first adsorbent 380*a*, second adsorbent 380*b*, and third adsorbent 380*c* may be the same adsorbent or a different adsorbent. In one example, the adsorbent is activated charcoal (e.g., carbon).

First vent branch 328 includes a first CVV 336 disposed therein for controlling flow between first canister 306 and vent line 324. Similarly, second vent branch 332 includes a second CVV 338 disposed therein for controlling flow between second canister 308 and vent line 324. Further, vent line 324 may include a third CVV 344, particularly when bleed canister 342 is included. Vent line 324 may vent at least a portion of evaporative emissions control system 319 to atmosphere when CVV 344 is open. For example, CVV 344 may function similarly to CVV 214 of FIG. 2. A controller (such as controller 12 of FIG. 2) may actuate third CVV 344 to a closed position during evaporative emissions system diagnostic testing (e.g., leak detection), for example. When evaporative emissions control system 319 does not include bleed canister 342, first CVV 336 and second CVV 338 may be commanded closed to seal the respective canister from the atmosphere.

First fuel vapor storage canister 306 and second fuel vapor storage canister 308 are further selectively coupled to a fuel tank 346 of fuel system 318 via a load line 348. Fuel tank 346 includes a FTPT 350 to measure pressure of the fuel tank, as described above with respect to FIG. 2. Load line 348 is a branched loading passage that is bifurcated at a third node 347 into a first load line branch 356 and a second load line branch 358 and includes a balance valve 352 arranged at third node 347. First canister 306 is coupled to first load line branch 356 of load line 348 via a first load port 360. Second canister 308 is coupled to second load line branch 358 of load line 348 via a second load port 362. First fuel vapor storage canister 306 and second fuel vapor storage canister 308 are selectively coupled to fuel tank 346 via balance valve 352. Balance valve 352 may be a three-way variable bleed valve (VBV), in one example. As such, balance valve 352 may also be referred to as VBV 352 herein. Balance valve 352 may be used to direct flow between fuel tank 346 and one or both of first canister 306 and second canister 308, as further described below. First fuel vapor storage canister 306 and second fuel vapor storage canister 308 may be arranged in parallel in evaporative emissions control and fuel system 300, as described above, which may allow a substantially equal amount of air to flow through each of first vent branch 328 and second vent branch 332, a substantially equal amount of fuel vapor to flow through each of first purge branch 312 and second purge branch 316, and a substantially equal amount of fuel vapor to flow through each of first load line branch 356 and second load line branch 358. Branches and regions of purge line 304, vent line 324, and load line 348 may be sized such that a total length of purge line 304, vent line 324, and load line 348 are similar in diameter and length for each canister.

Flow may be adjusted by differently actuating valves in evaporative emissions control and fuel system 300, including first CVV 336, second CVV 338, and VBV 352. Each of first CVV 336 and second CVV 338 are actuatable by a vehicle control system, such as control system 190 of FIG. 1 or control system 290 of FIG. 2. Upon actuation, each of first CVV 336 and second CVV 338 may be adjusted between a first, open (e.g., fully open) position and a second, closed (e.g., fully closed) position. When in the (fully) open position, each CVV may couple a respective canister to vent line 324. When in the (fully) closed position, the CVV may isolate the respective canister from vent line 324. First CVV 336 and second CVV 338 may be independently actuated such that first CVV 336 may be adjusted to the open or closed position irrespective of whether second CVV 338 is in the open or closed position (and vice versa). When first CVV 336 or second CVV 338 is in the closed position, the respective canister may be isolated from vent line 324.

VBV 352 may be used to adjust a flow of fuel vapor through load line 348 by coupling first canister 306 to fuel tank 346 when VBV 352 is in a first position, coupling second canister 308 to fuel tank 346 when VBV 352 is in a second position, and coupling both first fuel vapor storage canister 306 and second fuel vapor storage canister 308 to fuel tank 346 when VBV 352 is in a third position. The third position in which both first canister 306 and second canister 308 are in communication with fuel tank 346 may be a default position of VBV 352, at least in some examples. By selective isolating first canister 306 or second canister 308 from fuel tank 346 based on the position of VBV 352, the isolated canister is blocked from backflow of fuel vapor into the respective load port (e.g., first load port 360 of first canister 306 or second load port 362 of second canister 308).

In some examples, VBV 352 may control the flow path via a mechanical mechanism, such as springs. Commanding VBV 352 on may include unlocking the VBV such that the mechanical mechanism of VBV 352 is able to move and open to one of the first, second, and third positions. For a path with higher flow (e.g., a larger pressure drop between fuel tank 346 and the respective canister of the first or the second canisters), the VBV, when configured as a spring-loaded valve, may partially open in one of the first, the second, and the third position to produce a lower pressure drop. For example, when a pressure of first canister 306 is higher than a pressure of second canister 308, VBV 352 may be in the second position, coupling second canister 308 to fuel tank 346. When VBV 352 is off, VBV 352 may be locked in the present position (e.g., the first, second, or third position) such that the VBV may not adjust to a different position of the first, second, and third positions.

Blocking backflow of fuel vapor into the isolated canister of first fuel vapor storage canister 306 and second fuel vapor storage canister 308 may reduce unequal loading of fuel vapors into the first and the second canisters. In an example where VBV 352 is omitted, a disproportionately higher level of fuel vapor may be loaded into what would be the isolated canister, which may result in one of the first and the second canisters being more restricted (e.g., having a higher load) than the other. Further, inclusion of VBV 352 may prevent backflow during canister purging and restriction flow measurement. When in the first position, VBV 352 couples first canister 306 to the fuel tank 346, blocking backflow to the second canister 308. When in the second position, the VBV 352 couples the second canister 308 to the fuel tank 346, blocking backflow to first canister 306.

When configured with "n" fuel vapor storage canisters, where n is a number is more than 2, the evaporative emissions control and fuel system 300 may include, for each canister, a CVV selectively coupling each of the n number of canisters to the atmosphere via a vent line, where the vent line may be branched such that each of n number of branches of the vent line is connected to a single canister of the n canisters with a single CVV positioned thereon, and the n number of branches may merge at a single branch point to combine flow from each of the n number of canisters to the atmosphere. Additionally, the balance valve used to adjust flow may be configured as a n-way balance valve with n+1 positions (e.g., if n=3, the n-way balance valve may have four positions). For example, when configured with three canisters, each canister is coupled with a canister vent valve positioned on a branch of a vent line to selectively couple the respective canister to the atmosphere. The VBV may be configured as a four-way balance valve to selectively couple a first canister to the fuel tank when in a first position, a second canister to the fuel tank when in a second position, or a third canister to the fuel tank when in a third position. A default position (e.g., a fourth position) of the four-way balance valve may couple all three canisters to the fuel tank.

For different values of n, the n-way balance valve may similarly be configured to couple one of n number of canisters to the fuel tank for each of n positions of the balance valve and to couple all of the n number of canisters to the fuel tank when in a default position. Further, a second purge line with a second CPV positioned thereon may be included in the evaporative emissions control and fuel system 300 when configured with n fuel vapor storage canisters to selectively couple at least one of the n number of canisters to the intake manifold. Canister purging operation of the EVAP system configured with n canisters may be conducted as described above in FIG. 3 and as further described in FIGS. 4-5B. In this way, an evaporative emissions control system with more than two parallel fuel vapor storage canisters may be provided.

However, in some examples, fuel vapor storage canisters may become degraded such that symmetric canisters (e.g., canisters with a same load capacity), such as first fuel vapor storage canister 306 and second fuel vapor storage canister 308, may have different working capacities. For example, carbon pellets in the canisters used as adsorbent to trap fuel vapors may become contaminated through water ingestion or liquid fuel carryover, which may result in the contaminated carbon pellets being no longer able to store fuel vapors and reducing the working capacity of the correspond canister. Thus, as used herein, the term "working capacity" refers to a canister's capacity to absorb and desorb fuel vapors, which may be different than its manufactured load capacity. However, current diagnostic systems may be unable to distinguish the working capacity of one fuel vapor storage canister from another that is coupled in parallel. If canister degradation goes unnoticed, evaporative emissions may increase.

Figure 4:
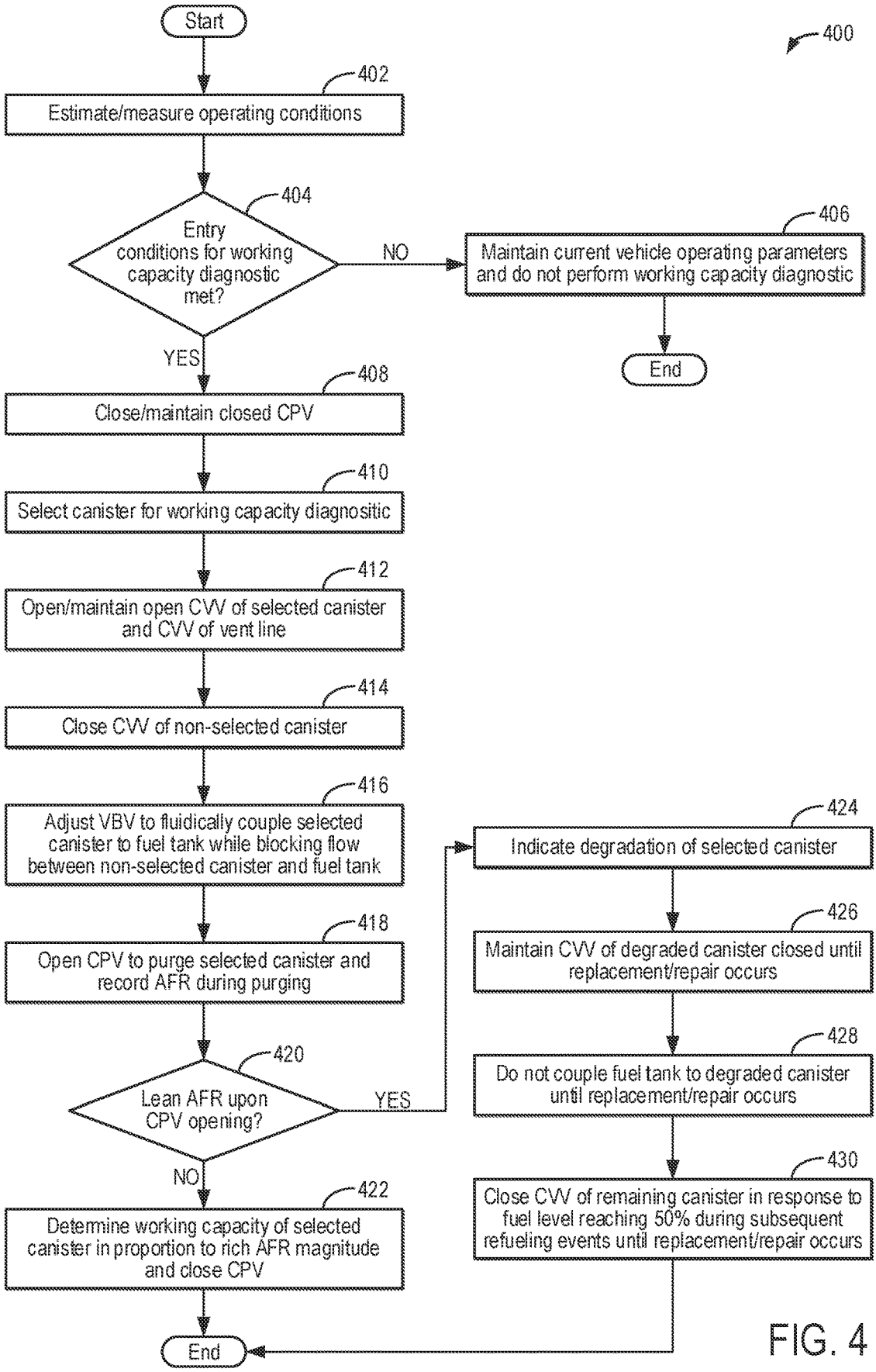
FIG. 4 shows an example method for diagnosing a working capacity of parallel fuel vapor storage canisters in an evaporative emissions control system of a vehicle.

Thus, FIG. 4 shows an example method 400 for diagnosing a working capacity of each fuel vapor storage canister of an evaporative emissions control system having a plurality of fuel vapor storage canisters in parallel. Diagnosing the working capacity also may be referred to herein as performing a working capacity diagnostic. Instructions for carrying out method 400 and the rest of the methods included herein may be executed by a controller (e.g., controller 12 of FIG. 2) based on instructions stored on a memory of the controller and in conjunction with signals received from sensors of the engine system, such as the sensors described above with reference to FIGS. 1-3. The controller may employ engine actuators of the engine system to adjust engine operation according to the methods described below. For example, method 400 will be described with respect to the evaporative emissions control and fuel system 300 of FIG. 3, which includes two fuel vapor storage canisters. However, it may be understood that the evaporative emissions control system may be configured with more than two canisters and respective elements, such as canister vent valves, as described above with respect to FIG. 3.

At 402, method 400 includes estimating and/or measuring operating conditions. The operating conditions include engine and vehicle operating conditions. The vehicle operating conditions may be estimated based on one or more outputs of various sensors of the vehicle, such as the sensors described above with reference to FIGS. 1-3. The vehicle operating conditions may include vehicle speed, a fuel level of a fuel tank (e.g., determined from a fuel level input), an amount of time (e.g., a duration) since a most recent refueling event, an amount of fuel received during the most recent refueling event, and a leak test status of an evaporative emissions control system. The engine operating conditions may include, for example, an engine speed, an engine load, an engine coolant temperature, an engine torque output, vehicle wheel torque, a temperature of an emission control device, etc.

At 404, method 400 includes determining if entry conditions for performing the working capacity diagnostic are met. The entry conditions may include, for example, an indication of a successful leak test having been performed within a threshold duration. The indication of the successful leak test may specify that the leak test has been performed and that the evaporative emissions control system passed the leak test. The threshold duration may be, for example, a number of hours or days, such as in a range between 1 and 7 days. The entry conditions may further include a refueling event having occurred since a last key-off event (e.g., where the engine and/or the vehicle is shut down and at rest) that produced at least a threshold change in the fuel level of the fuel tank. The at least threshold change may include going from an initial fuel level that is less than or equal to a lower threshold fuel level to a final fuel level that is greater than or equal to an upper threshold fuel level. The lower threshold fuel level may be a near empty fuel tank level, such as less than 25% of a total capacity of the fuel tank, while the upper threshold fuel level may be a nearly full fuel tank level, such greater than 75% of the total fuel tank capacity. As another example, the lower threshold fuel level may be a value in a range from 0-10% of the total fuel tank capacity, and the upper threshold fuel level may be a value in a range from 90-100% of the total fuel tank capacity. Thus, the refueling event includes the fuel tank being substantially fully refilled for the entry conditions to be met. Notably, the at least threshold change in the fuel level during the refueling event is expected to load both fuel vapor storage canisters of the evaporative emissions system, enabling the working capacity of both canisters to be accurately tested.

The entry conditions may further include the temperature of the emission control device being greater than a threshold catalyst temperature. The threshold catalyst temperature refers to a non-zero, predetermined temperature value that is stored in memory. The threshold catalyst temperature may be a light-off temperature of the emission control device, above which the emission control device may be maximally effective at treating exhaust gas components and thus, reducing vehicle emissions. As another example, the entry conditions may further include the engine coolant temperature being greater than a threshold engine temperature. The threshold engine temperature may be a non-zero temperature value that is stored in memory, above which the engine is considered to be warm (e.g., at least 160° F.). As still another example, the entry conditions may further include an indication that closed loop fuel control is being used and that an exhaust gas oxygen sensor (e.g., exhaust gas oxygen sensor 226 of FIG. 2) has reached a pre-determined operating temperature. The entry conditions may further include the vehicle speed being at least a threshold speed. The threshold speed may be a pre-determined, non-zero speed that is stored in memory and corresponds to a steady state cruising speed (e.g., 40 miles per hour). All of the entry conditions may be satisfied for the entry conditions for performing the canister working capacity diagnostic to be considered met. Thus, the entry conditions may not be considered met in response to a portion of the entry conditions being satisfied.

If the entry conditions for performing the working capacity diagnostic are not met, method 400 proceeds to 406 and includes maintaining the current vehicle operating parameters and not performing the working capacity diagnostic. For example, the working capacity diagnostic may not be performed in response to a refueling event having less than the threshold change in the fuel level. As such, the evaporative emissions control system may continue to be operated based on a last known working capacity of each fuel vapor storage canister. Further, if it is not known that either of the fuel vapor storage canisters are degraded, a balance valve (e.g., VBV 352 of FIG. 3) may continue to be adjusted to load both fuel vapor storage canisters, and full fuel tank fills may be enabled. Method 400 may then end. For example, method 400 may be repeated in response to refueling event to re-evaluate whether or not the entry conditions are met.

Returning to 404, if the entry conditions for performing the working capacity diagnostics are met, method 400 proceeds to 408 and includes closing/maintaining closed a CPV. The CPV (e.g., CPV 302) controls flow between an intake manifold of the engine and the evaporative emissions control system. When closed, the CPV blocks flow between the intake manifold and the evaporative emissions control system. The CPV may be a normally closed valve and thus, method 400 may include maintaining closed the CPV. Alternatively, if the CPV is open, method 400 includes closing the CPV so that air and fuel vapors do not flow from the evaporative emissions system and the intake manifold. As such, the CPV is closed or maintained closed in response to the entry conditions for performing the working capacity diagnostics being met.

At 410, method 400 includes selecting a canister for the working capacity diagnostic. The working capacity diagnostic includes diagnosing one fuel vapor storage canister at a time. Therefore, the controller may determine which canister to select for a current iteration of the working capacity diagnostic. For example, the controller may log previous iterations of the working capacity diagnostic in memory, such as a date/time at which the working capacity diagnostic was performed and which canister was evaluated. Therefore, the controller may determine which canister was more recently evaluated and select the other canister for the present evaluation. For example, a first canister (e.g., first fuel vapor storage canister 306 of FIG. 3) may be selected in response to a second canister (e.g., second fuel vapor storage canister 308 of FIG. 3) having been assessed more recently, while the second canister may be selected in response to the first canister having been assessed more recently.

Additionally or alternatively, the canister may be selected according to a default order stored in memory. For example, the default order may include the first canister followed by the second canister, and the controller may select the first canister in response to an absence of an indication that the working capacity diagnostic has been completed on the first canister and select the second canister in response to a presence of the indication that the working capacity diagnostic has been completed on the first canister. In such an example, the indication may be cleared in response to the working capacity diagnostic being completed on the second canister so that the first canister may be selected during a subsequent iteration of the working capacity diagnostic. In some examples, selecting the canister for the working capacity diagnostic may further include selecting a non-degraded canister. For example, if one of the fuel vapor storage canisters is determined to be degraded (e.g., via a prior iteration of method 400), then it may not be selected for the working capacity diagnostic until repaired or replaced.

At 412, method 400 includes opening/maintaining open a CVV of the selected canister and a CVV of a vent line. For example, when the first canister is selected (e.g., is the selected canister), a first CVV (e.g., first CVV 336 of FIG. 3) coupled in a first vent branch between the first canister and a vent line to atmosphere may be commanded open. The first CVV may be a normally open valve, and thus, the first CVV may be maintained open when already open. Similarly, when the second canister is the selected canister, a second CVV (e.g., second CVV 338 of FIG. 3) coupled in a second vent branch between the second canister and the vent line may be commanded open, if closed, or maintained open if already open. In examples where the evaporative emissions control system includes a bleed canister element and a third CVV (e.g., third CVV 344 of FIG. 3) in the vent line to atmosphere, the third CVV is commanded open if closed or maintained open if already open. In this way, the selected canister may be fluidically coupled to atmosphere, enabling flow between the selected canister and atmosphere.

At 414, method 400 includes closing the CVV of the non-selected canister. For example, when the first canister is the selected canister, the second CVV disposed in the second vent branch between the second canister and the vent line is commanded closed (or maintained closed if already closed). When the second canister is the selected canister, the first CVV disposed in the first vent branch between the first canister and the vent line is commanded closed (or maintain closed). In this way, the non-selected canister is sealed from atmosphere.

At 416, method 400 includes adjusting a VBV to fluidically couple the selected canister to the fuel tank while blocking flow between the non-selected canister and the fuel tank. As explained above with respect to FIG. 3, the VBV (e.g., VBV 352 of FIG. 3) may be a three-way valve that may be used to selectively couple one or both of the canisters to the fuel tank. For example, when the first canister is selected, the VBV may be adjusted to a first position that couples the first canister to the fuel tank and blocks flow between the fuel tank and the second canister. As such, back flow may be prevented to the second canister, and the first canister is isolated from the second canister in order to evaluate the working capacity of the first canister alone. For example, with the VBV in the first position and the second CVV closed, the second canister may be sealed from atmosphere and from the remainder of the evaporative emissions and fuel system. When the second canister is selected, the VBV may be adjusted to a second position that couples the second canister to the fuel tank and blocks flow between the fuel tank and the first canister. As a result, the second canister may be isolated from the first canister to evaluate the working capacity of the second canister alone, and the first canister may be sealed from atmosphere via the closed first CVV and the remainder of the evaporative emissions and fuel system.

At 418, method 418 includes opening the CPV to purge the selected canister and recording (e.g., measuring) an air-fuel ratio (AFR) during purging. Upon opening the CPV, the selected canister is fluidically coupled to the intake manifold of the engine, and vacuum from the intake manifold may pull any stored fuel vapors from the selected canister to the intake manifold while fresh air is also pulled through the selected canister via the vent line and the open CVVs. Flow paths during purging each canister in isolation are illustrated in FIGS. 5A and 5B and will be further described below. Thus, the controller may operate the evaporative emissions control system with the first CVV open, the second CVV closed, the CPV open, and the VBV in the first position wherein only the first fuel vapor storage canisters is fluidically coupled to the fuel tank to individually purge the first fuel vapor storage canister and determine the working capacity of the first fuel vapor storage canister. Similarly, the controller may operate the evaporative emissions control system with the first CVV closed, the second CVV open, the CPV open, and the VBV in the second position wherein only the second fuel vapor storage canisters is fluidically coupled to the fuel tank to individually purge the second fuel vapor storage canister and determine the working capacity of the second fuel vapor storage canister.

At least a portion of the purged fuel vapors may be consumed via combustion in the engine, and remaining fuel vapors may be expelled with exhaust gas to an exhaust system of the engine (e.g., exhaust system 225 of FIG. 2). The exhaust gas oxygen sensor may be positioned in the exhaust system, and measurements from the exhaust gas oxygen sensor may be used by the controller to determine the AFR of the exhaust gas. Herein, the AFR will be discussed as a relative AFR, defined as a ratio of an actual AFR of a given mixture to stoichiometry and represented by lambda ($\lambda$). A lambda value of 1 occurs at stoichiometry (e.g., during stoichiometric operation), wherein the air-fuel mixture produces a complete combustion reaction. A rich exhaust gas feed ($\lambda<1$) results from air-fuel mixtures with more fuel, including fuel vapors from the purging, relative to stoichiometry. For example, when the engine is enriched, more fuel is supplied to the engine than is used for producing a complete combustion reaction with an amount of air ingested, resulting in excess, unreacted fuel being exhausted. In contrast, a lean exhaust gas feed ($\lambda>1$) results from air-fuel mixtures with less fuel relative to stoichiometry. For example, when the engine is enleaned, less fuel is delivered to the engine than is used for producing a complete combustion reaction with the amount of air ingested, resulting in excess, unreacted air being exhausted.

The engine may be operated at stoichiometry during the working capacity diagnostic, and so deviations or disturbances in the measured AFR from stoichiometry may be attributed to the purging. In particular, the AFR is expected to shift rich in response to purging the selected canister, as the selected canister has been loaded via the refueling event. However, if the canister has a degraded working capacity and is unable to sufficiently store fuel vapors from the refueling, the AFR may instead shift lean in response to purging the selected canister, as fresh air is pulled through the evaporative emissions control system and to the intake manifold with little to no stored fuel vapors to offset the fresh air in the purge flow.

Therefore, at 420, method 400 includes determining if a lean AFR is measured upon CPV opening. As explained above, a lean shift in the AFR upon CPV opening indicates that the selected canister is unable to sufficiently store fuel vapors, whereas a rich shift in the AFR upon CPV opening indicates purging of stored fuel vapors (e.g., the working capacity of the canister is sufficient to store refueling vapors). As used herein, the term "upon CPV opening" refers to a change in the AFR that occurs as a result of opening the CPV. For example, the change in the AFR may occur substantially simultaneously with the CPV opening, such as within seconds of the CPV being commanded open. For example, any delay between the CPV opening and the shift in the AFR may be attributed to an amount of time it takes exhaust from the ingested purge flow to reach the exhaust gas oxygen sensor after it is at least partially combusted in the engine.

If the AFR does not shift lean upon CPV opening, such as when the measured AFR is rich, method 400 proceeds to 422 and includes determining the working capacity of the selected canister in proportion to a richness of the AFR and closing the CPV. For example, the CPV may be closed in response to the purging being completed, such as due to the AFR shifting back to stoichiometry or shifting lean. As such, the evaporative emissions control system may be isolated from the intake manifold, with the closed CPV blocking flow between the evaporative emissions system and the engine. The working capacity may be determined in proportion to the rich AFR measured during the purging. For example, as a magnitude of the rich AFR increases (e.g., lambda becomes smaller), the working capacity of the selected canister may increase. In some examples, the controller may determine an area under the curve of the exhaust gas oxygen sensor output during the purging (e.g., a time period between opening the CPV and closing the CPV) and may further determine the working capacity by inputting the area under the curve into a look-up table stored in memory that directly relates the area under the curve to the working capacity. In such an example, the working capacity of the selected canister may be output from the look-up table. Alternatively, the controller may perform a slope calculation on the exhaust gas oxygen sensor output during the purging and input the slope calculation into a look-up table that relates the slope calculation to the working capacity. Further, in some examples, the controller may store the determined working capacity of the selected canister in memory. As such, the controller may track any changes in the working capacity over time, such as a decrease in the working capacity as the canister ages.

Method 400 may then end. For example, at least portions of method 400 may be subsequently repeated to diagnose the currently non-selected canister. Thus, method 400 may be repeated until the working capacity of every canister in the evaporative emissions control system is assessed. Further, it may be understood that other engine features that may cause AFR adjustments may not be utilized during the working capacity diagnostic, such as operating in a variable displacement engine mode, adjusting exhaust gas recirculation flow, adjusting cam timing, and so forth.

Returning to 420, if a lean AFR is measured upon CPV opening, method 400 proceeds to 424 and includes indicating degradation of the selected canister. That is, because the lean AFR is measured, it may be determined that the selected canister is unable to sufficiently store fuel vapors, including refueling vapors from the refueling event. Indicating degradation of the selected canister may include storing an associated diagnostic trouble code (DTC) in memory. The DTC may indicate that the working capacity degradation has been detected as well as the identity of the degraded canister. In some examples, indicating degradation of the selected canister may include the controller outputting a message to an operator of the vehicle via an interface, such as message center 196 of FIG. 1. The message may provide information regarding the degradation as well as recommending repair or replacement of the degraded canister. Further, the message may indicate that the fueling capacity of the fuel tank may be reduced while the canister is degraded, as will be elaborated below (e.g., at 430).

At 426, method 400 includes maintaining the CVV of the degraded canister closed until replacement or repair (e.g., reloading with new adsorbent) occurs. By maintaining the CVV closed, a vent port of the degraded canister is sealed so that the degraded canister will not be coupled to atmosphere. For example, the first CVV may be maintained closed in response to degradation of the first canister being indicated, and the second CVV may be maintained closed in response to degradation of the second canister being indicated. As such, vapor flow may not occur across the degraded canister. The CVV of the degraded canister may be kept closed in order to prevent flow across the degraded canister, as purging the degraded canister may result in contamination being introduced into the remainder of the evaporative emissions system.

At 428, method 400 includes not coupling the fuel tank to the degraded canister until replacement or repair of the degraded canister occurs. Because the degraded canister is unable to sufficiently store fuel vapors, it may be counterproductive to couple the degraded canister to the fuel tank. For example, coupling the fuel tank to the degraded canister may increase evaporative emissions. Therefore, the VBV may be adjusted to seal a load port of the degraded canister. For example, the VBV may be maintained in the second position in response to degradation of the first canister being indicated so that only the second canister is coupled to the fuel tank. As another example, the VBV may be maintained in the first position in response to degradation of the second canister being indicated so that only the first canister is coupled to the fuel tank. As still another example, the controller may not adjust the VBV to the first position or the third position in response to degradation of the first canister being indicated and may not adjust the VBV to the second position or the third position in response to degradation of the second canister being indicated. As such, the degraded canister may be prevented from loading fuel vapors as well as from purging fuel vapors.

At 430, method 400 includes closing the CVV of the remaining (e.g., non-degraded) canister in response to the fuel level reaching 50% during subsequent refueling events until replacement or repair of the degraded canister occurs. For example, because one fuel vapor storage canister is degraded and not used to store fuel vapors, the evaporative emissions control system includes a maximum of half its original fuel vapor storage capacity. Therefore, a maximum refueling capacity of the fuel tank may be reduced by half (e.g., to 50% of the total capacity of the fuel tank) to ensure that the evaporative emissions control system has enough working capacity to store fuel vapors from the refueling as well as running loss vapors and diurnal vapors. Because the degraded canister is sealed by closing its associated CVV and adjusting the VBV to block flow to the degraded canister, all of the refueling vapors may be directed to the remaining canister. In order to limit the refueling to 50% capacity, the CVV of the remaining canister may be closed in response to the fuel level input indicating 50% capacity. As a result, back pressure may be produced in the fuel tank, which may in turn shut off a refueling nozzle. In some examples, the operator may be able to override the 50% fuel tank capacity limit (e.g., via the message center). However, doing so may increase evaporative emissions, which may be indicated to the operator via the message center and logged in controller memory.

Note that in examples where more than two parallel fuel vapor storage canisters are included, the maximum refueling capacity may be reduced in proportion to a contribution of the degraded fuel vapor storage canister to the overall evaporative emissions control system fuel vapor storage capacity. That is, the maximum refueling capacity may be reduced by 100/n, where n is the number of fuel vapor storage canisters in the evaporative emissions system. As such, the maximum refueling capacity may be reduced by 50% to a 50% maximum refueling capacity when n is 2, reduced by 33% to a 67% maximum refueling capacity when n is 3, reduced by 25% to a 75% maximum refueling capacity when n is 4, and so forth.

Method 400 may then end. In this way, canister working capacity is measured for at least two canisters in an evaporative emissions control system having a plurality of fuel vapor storage canisters arranged in parallel. Further, method 400 provides mitigating actions that may be performed in response to degradation of the canister working capacity being detected in order to decrease vehicle evaporative emissions.

Positions (e.g., open/closed) of the first and second CVVs as well as the VBV while performing the working capacity diagnostics according to method 400 are shown in FIGS. 5A-5B. Evaporative emissions control and fuel system 300 of FIG. 3 is replicated in FIGS. 5A and 5B, with like components numbered the same and not reintroduced for brevity. Some reference numbers are omitted for illustrative clarity, although it may be understood that all of the components introduced with respect to FIG. 3 may be present in the systems shown in FIGS. 5A and 5B. Evaporative emissions control and fuel system 300 is shown in a first configuration 500 in FIG. 5A and in a second configuration 502 in FIG. 5B. Thicker lines with arrows in both of FIGS. 5A and 5B show flow through the evaporative emissions control and fuel system 300, as will be elaborated below.

First configuration 500 of FIG. 5A may be used to determine the working capacity of first canister 306. First configuration 500 includes first CVV 336 in the open position, second CVV 338 in the closed position, third CVV 344 in the open position, CPV 302 in the open position, and VBV 352 in the first position. With VBV 352 in the first position, fuel tank 346 is fluidically coupled to first canister 306 while flow is blocked between fuel tank 346 and second canister 308. With CPV 302 open, vacuum from an intake manifold of the engine draws gases (e.g., air and fuel vapors) through evaporative emissions and fuel system 300. In particular, air flows in from the atmosphere through vent line 324 via bleed canister 342 and the open third CVV 344, when included, and continues through the open first CVV 336, through first vent branch 328, and into first canister 306. Additionally, fuel vapors from fuel tank 346 are drawn into first canister 306 via load line 348, as directed by VBV 352 in the first position. Air and fuel vapors in first canister 306 flow out of first canister 306 to the intake manifold via first purge branch 312.

Second configuration 502 of FIG. 5B may be used to determine the working capacity of second canister 308. Second configuration 502 includes first CVV 336 in the closed position, second CVV 338 in the open position, third CVV 344 in the open position, CPV 302 in the open position, and VBV 352 in the second position. With VBV 352 in the second position, fuel tank 346 is fluidically coupled to second canister 308 while flow is blocked between fuel tank 346 and first canister 306. As in first configuration 500, air flows in from the atmosphere through vent line 324 via bleed canister 342 and the open third CVV 344, when included. However, the air flow then continues through the open second CVV 338, through second vent branch 332, and into second canister 308. Additionally, fuel vapors from fuel tank 346 may be drawn into second canister 308 via load line 348, as directed by VBV 352 in the second position. Air and fuel vapors in second canister 308 flow out of second canister 308 to the intake manifold via second purge branch 316.

Next, FIG. 6 shows an exemplary timeline 600 for performing a working capacity diagnostic on two symmetrical fuel vapor storage canisters arranged in parallel in an evaporative emissions control and fuel system of a vehicle (e.g., evaporative emissions control and fuel system 300 of FIG. 3). For example, the working capacity diagnostic may be performed by a controller (e.g., controller 12 of FIG. 2) according to method 400 of FIG. 4. A position of a CPV (e.g., CPV 302 of FIG. 3) is shown in a plot 602, a position of a first CVV coupled between a vent line and a first canister is shown in a plot 604, a position of a second CVV coupled between the vent line and a second canister is shown in a plot 606, a VBV position is shown in a plot 608, an AFR is shown in a plot 610, a fuel level of a fuel tank is shown in a plot 612, and an indication of canister degradation is shown in a plot 614.

For all of the above, the horizontal axis represents time, with time increasing along the horizontal axis from left to right. The vertical axis of each plot represents the labeled parameter. For example, the vertical axis for plots 602, 604, and 606 shows the position of the corresponding valve as open (e.g., fully open) or closed (e.g., fully closed), as labeled. For plot 608, the vertical axis shows whether the VBV is in a first position wherein only the first canister is fluidically coupled to the fuel tank, a second position wherein only the second canister is coupled to the fuel tank, or a third position wherein both the first canister and the second canister are fluidically coupled to the fuel tank. The vertical axis of plot 610 shows the AFR relative to stoichiometry, wherein values greater than stoichiometry are lean and values less than stoichiometry are rich. For plot 612, the vertical axis shows the fuel level as a percentage of a total capacity of the fuel tank. For plot 614, the vertical axis indicates whether indication of canister degradation is off (e.g., no degradation is indicated), degradation of the first canister is indicated, or degradation of the second canister is indicated.

Between time t0 and time t1, a refueling event occurs while the vehicle is off. In particular, the fuel level (plot 612) goes from below a lower threshold level, represented by a dashed line 616, to above an upper threshold level, represented by a dashed line 618. Because the fuel level has gone from below the lower threshold level to above the upper threshold level, a refueling event having greater than a threshold change in the fuel level is indicated. As such, an entry condition for performing the working capacity diagnostic is met. Further, because the VBV is in the third position (plot 608), the first CVV (plot 604) is open, and the second CVV (plot 606) is open during the refueling, both the first canister and the second canister may be loaded with refueling vapors.

At time t1, the vehicle is turned on and the engine is started. The engine is operated with stoichiometric fueling, and the AFR (plot 610) undergoes small fluctuations about stoichiometry. The CPV (plot 602) is maintained closed, as canister purging is not desired. The first CVV (plot 604) and the second CVV (plot 606) are both open, coupling the first and second canister to atmosphere, respectively. Further, the VBV is in the third position (plot 608), with the first canister and the second canister both fluidically coupled to the fuel tank. As such, vapors from the fuel tank may continue to be stored in both the first canister and the second canister.

Shortly after the engine is started, at time t2, it is determined that the entry conditions for performing the working capacity diagnostic are met. For example, in addition to the refueling event between time t0 and time t1, the controller may determine that the evaporative emissions control system has passed a leak test within a pre-determined amount of time. In response to the entry conditions for performing the working capacity diagnostic being met at time t2, the first canister is selected for assessment. To assess the first canister in isolation from the second canister, the first CVV is maintained open (plot 604), the second CVV is closed (plot 606) to block vapor flow across the second canister, and the VBV valve is adjusted to the first position (plot 608) to maintain fluidic communication between the fuel tank and the first canister while blocking flow between the fuel tank and the second canister. As such, the second canister is sealed. Further, the CPV is opened (plot 602) to purge the first canister.

The first canister is purged between time t2 and time t3. The AFR (plot 610) shifts rich in response to the CPV being opened at time t2. As such, degradation of the working capacity of the first canister is not detected, and so the indication of canister degradation remains off (plot 614). Further, the controller may calculate the working capacity of the first canister in proportion to the magnitude of the rich AFR shift. The first canister may be purged, with the CPV maintained open, until the AFR decreases back to stoichiometry, for example.

At time t3, the AFR (plot 610) decreases to stoichiometry, and in response, the CPV (plot 602) is closed to discontinue the purging and the working capacity assessment of the first canister. The engine is briefly operated at stoichiometry before the working capacity of the second canister is commenced at time t4. To assess the second canister in isolation from the first canister, the first CVV is closed (plot 604) to block vapor flow across the first canister, the second CVV is opened (plot 606), and the VBV valve is adjusted to the second position (plot 608) to fluidically couple the fuel tank and the second canister while blocking flow between the fuel tank and the first canister. As such, the first canister is sealed. The CPV is opened (plot 602) at time t4 to purge the second canister and evaluate its working capacity.

In response to the CPV being opened at time t4, the AFR (plot 610) shifts lean, indicating that the working capacity of the second canister to store fuel vapors is degraded. In response, degradation of the second canister is indicated (plot 614) at time t5. Further, the CPV (plot 602) and the second CVV (plot 606) are closed at time t5, as purging the degraded canister is not productive and may introduce contaminants to other components of the evaporative emissions control system and/or the engine. Further still, the VBV is adjusted to the first position (plot 608) so that the fuel tank is only fluidically coupled to the first, non-degraded canister. The first CVV is re-opened (plot 604) so that fuel vapors may be stored in the first canister. Additionally, a temporary maximum fuel tank capacity is set at 50% capacity, as indicated by a small dashed line 620. As such, refueling events following time t5 may be terminated when the fuel level of the fuel tank reaches 50% until the degraded second canister is replaced or repaired in order to reduce evaporative emissions from the vehicle.

In this way, at least two canisters, arranged in a parallel loading and unloading flow direction, may be evaluated for their fuel vapor storage working capacity by separately purging each canister following a refueling event and measuring a corresponding change in an exhaust gas AFR. Arranging canisters in parallel reduces a back pressure associated with a single large canister, and using a balancing valve as well as a canister vent valve associated with each of the canisters to adjust flow allows for selective and dynamic adjusting of flow through each canister throughout a vehicle lifetime, as canister working capacity may change over time due to degradation, for example. As a result, if one canister becomes degraded, the other canister may be used alone for storing fuel vapors until the degraded canister is repaired or replaced. As a result, vehicle evaporative emissions may be decreased.

The technical effect of using onboard refueling vapor recovery via a plurality of parallel fuel vapor storage canisters in heavy duty vehicles and diagnosing a working capacity of each fuel vapor storage canister individually is that evaporative emissions from the vehicle may be decreased.

The disclosure also provides support for a method, comprising: in response to greater than a threshold change in a fuel level of a fuel tank fluidically coupled to at least two fuel vapor storage canisters of an evaporative emissions control system during a refueling event, performing a canister working capacity diagnostic on each of the at least two fuel vapor storage canisters by measuring an exhaust gas air-fuel ratio (AFR) while independently purging each of the at least two fuel vapor storage canisters. In a first example of the method, performing the canister working capacity diagnostic on each of the at least two fuel vapor storage canisters by measuring the exhaust gas AFR while independently purging each of the at least two fuel vapor storage canisters comprises: selecting one of the at least two fuel vapor storage canisters to purge, indicating degradation of a working capacity of the selected one of the at least two fuel vapor storage canisters in response to the exhaust gas AFR shifting lean during the purging, and determining the working capacity of the selected one of the at least two fuel vapor storage canisters in response to the exhaust gas AFR shifting rich during the purging, wherein the working capacity is proportional to a richness of the exhaust gas AFR. In a second example of the method, optionally including the first example, independently purging each of the at least two fuel vapor storage canisters comprises: opening or maintaining open a first canister vent valve (CVV) coupled between a first vent port of the selected one of the at least two fuel vapor storage canisters and a vent line, and closing or maintaining closed a CVV coupled between a vent port of each of the at least two fuel vapor storage canisters that is not the selected one of the at least two fuel vapor storage canisters and the vent line. In a third example of the method, optionally including one or both of the first and second examples, independently purging each of the at least two fuel vapor storage canisters further comprises: adjusting a balance valve coupled between the fuel tank and a branched loading passage configured to flow fuel vapors from the fuel tank to each of the at least two fuel vapor storage canisters to a first position where the fuel tank is fluidically coupled to the selected one of the at least two fuel vapor storage canisters and not fluidically coupled to each of the at least two fuel vapor storage canisters that is not the selected one of the at least two fuel vapor storage canisters, and opening a canister purge valve (CPV) positioned in a branched purge passage that fluidically couples an engine intake to a purge port of each of the at least two fuel vapor storage canisters. In a fourth example of the method, optionally including one or more or each of the first through third examples, the method further comprises: preventing vapor flow across the selected one of the at least two fuel vapor storage canisters in response to the degradation of the working capacity of the selected one of the at least two fuel vapor storage canisters being indicated. In a fifth example of the method, optionally including one or more or each of the first through fourth examples, preventing the vapor flow across the selected one of the at least two fuel vapor storage canisters comprises: maintaining the first CVV closed, and blocking flow between the fuel tank and the selected one of the at least two fuel vapor storage canisters via the balance valve. In a sixth example of the method, optionally including one or more or each of the first through fifth examples, the method further comprises: reducing a refueling capacity of the fuel tank in response to the degradation of the working capacity of the selected one of the at least two fuel vapor storage canisters being indicated. In a seventh example of the method, optionally including one or more or each of the first through sixth examples, the threshold change in the fuel level comprises going from an initial fuel level in the fuel tank that is less than a lower threshold fuel level to a final fuel level that is greater than an upper threshold fuel level during the refueling event, wherein the lower threshold fuel level is less than 25% of a total capacity of the fuel tank and the upper threshold fuel level is more than 75% of the total capacity of the fuel tank. In an eighth example of the method, optionally including one or more or each of the first through seventh examples, the lower threshold fuel level is in a first range from 0-10% of the total capacity of the fuel tank and the upper threshold fuel level is in a second range from 90-100% of the total capacity of the fuel tank. In a ninth example of the method, optionally including one or more or each of the first through eighth examples, performing the canister working capacity diagnostic on each of the at least two fuel vapor storage canisters is further in response to a successful leak test of the evaporative emissions control system having been performed within a threshold duration.

The disclosure also provides support for a method, comprising: separately diagnosing a working capacity of each of a first fuel vapor storage canister and a second fuel vapor storage canister of an evaporative emissions control system of a vehicle based on an exhaust gas air-fuel ratio measured while purging one of the first fuel vapor storage canister and the second fuel vapor storage canister and sealing the other of the first fuel vapor storage canister and the second fuel vapor storage canister. In a first example of the method, the evaporative emissions control system comprises a first canister vent valve (CVV) coupled between a first vent port of the first fuel vapor storage canister and a vent line to atmosphere, a second CVV coupled between a second vent port of the second fuel vapor storage canister, and a balance valve configured to fluidically couple one or both of the first fuel vapor storage canister and the second fuel vapor storage canister to a fuel tank of the vehicle, and wherein purging the one of the first fuel vapor storage canister and the second fuel vapor storage canister while sealing the other of the first fuel vapor storage canister and the second fuel vapor storage canister comprises: sealing the second fuel vapor storage canister by closing the second CVV and adjusting the balance valve to a first position that fluidically couples the first fuel vapor storage canister to the fuel tank and blocks flow between the second fuel vapor storage canister and the fuel tank, and purging the first fuel vapor storage canister while the second fuel vapor storage canister is sealed by opening or maintaining open the first CVV and opening a canister purge valve (CPV) positioned in a branched purge line fluidically coupling an engine intake to a purge port of each of the first fuel vapor storage canister and the second fuel vapor storage canister. In a second example of the method, optionally including the first example, purging the one of the first fuel vapor storage canister and the second fuel vapor storage canister while sealing the other of the first fuel vapor storage canister and the second fuel vapor storage canister further comprises: sealing the first fuel vapor storage canister by closing the first CVV and adjusting the balance valve to a second position that fluidically couples the second fuel vapor storage canister to the fuel tank and blocks flow between the first fuel vapor storage canister and the fuel tank, and purging the second fuel vapor storage canister while the first fuel vapor storage canister is sealed by opening or maintaining open the second CVV and opening the CPV. In a third example of the method, optionally including one or both of the first and second examples, separately diagnosing the working capacity of each of the first fuel vapor storage canister and the second fuel vapor storage canister of the evaporative emissions control system of the vehicle based on the exhaust gas air-fuel ratio measured while purging the one of the first fuel vapor storage canister and the second fuel vapor storage canister and sealing the other of the first fuel vapor storage canister and the second fuel vapor storage canister comprises: indicating degradation of the working capacity of the one of the first fuel vapor storage canister and the second fuel vapor storage canister in response to the exhaust gas air-fuel ratio shifting lean upon purging the one of the first fuel vapor storage canister and the second fuel vapor storage canister, and determining the working capacity of the one of the first fuel vapor storage canister and the second fuel vapor storage canister in proportion to a magnitude of the exhaust gas air-fuel ratio in response to the exhaust gas air-fuel ratio shifting rich upon purging the one of the first fuel vapor storage canister and the second fuel vapor storage canister. In a fourth example of the method, optionally including one or more or each of the first through third examples, the method further comprises: in response to the degradation of the working capacity of one of the first fuel vapor storage canister and the second fuel vapor storage canister: maintaining the one of the first fuel vapor storage canister and the second fuel vapor storage canister sealed, and reducing a maximum refueling capacity of a fuel tank of the vehicle by half.

The disclosure also provides support for a system, comprising: a fuel tank coupled to at least two fuel vapor storage canisters via a branched loading passage, a balance valve arranged at a branch point of the branched loading passage, and a controller with computer-readable instructions stored on non-transitory memory that, when executed, cause the controller to: determine a working capacity of each of the at least two fuel vapor storage canisters following a refueling event of the fuel tank, and prevent vapor flow across one of the at least two fuel vapor storage canisters in response to the working capacity of the one of the at least two fuel vapor storage canisters being degraded. In a first example of the system, to determine the working capacity of each of the at least two fuel vapor storage canisters following the refueling event of the fuel tank, the controller includes further computer-readable instructions stored on the non-transitory memory that, when executed, cause the controller to: individually purge each of the at least two fuel vapor storage canisters following the refueling event, and determine the working capacity of each of the at least two fuel vapor storage canisters based on an exhaust gas air-fuel ratio measured while individually purging each of the at least two fuel vapor storage canisters. In a second example of the system, optionally including the first example, the system further comprises: a branched vent line to atmosphere, a first canister vent valve (CVV) disposed in a first branch of the branched vent line, the first branch coupled to a first of the at least two fuel vapor storage canisters, a second CVV disposed in a second branch of the branched vent line, the second branch coupled to a second of the at least two fuel vapor storage canisters, a branched purge line fluidically coupling each of the at least two fuel vapor storage canisters to an engine intake, a canister purge valve (CPV) positioned in the branched purge line downstream of a branch point of the branched purge line, and wherein to individually purge each of the at least two fuel vapor storage canisters following the refueling event, the controller includes further computer-readable instructions stored on the non-transitory memory that, when executed, cause the controller to: operate with the first CVV open, the second CVV closed, the CPV open, and the balance valve in a first position wherein only the first of the at least two fuel vapor storage canisters is fluidically coupled to the fuel tank to individually purge the first of the at least two fuel vapor storage canisters, and operate with the first CVV closed, the second CVV open, the CPV open, and the balance valve in a second position wherein only the second of the at least two fuel vapor storage canisters is fluidically coupled to the fuel tank to individually purge the second of the at least two fuel vapor storage canisters. In a third example of the system, optionally including one or both of the first and second examples, to prevent vapor flow across one of the at least two fuel vapor storage canisters in response to the working capacity of the one of the at least two fuel vapor storage canisters being degraded, the controller includes further computer-readable instructions stored on the non-transitory memory that, when executed, cause the controller to: maintain the first CVV closed and not adjust the balance valve to the first position or a third position wherein each of the at least two fuel vapor storage canisters are fluidically coupled to the fuel tank in response to the first of the at least two fuel vapor storage canisters being degraded, and maintain the second CVV closed and not adjust the balance valve to the second position or the third position in response to the second of the at least two fuel vapor storage canisters being degraded. In a fourth example of the system, optionally including one or more or each of the first through third examples, to determine the working capacity of each of the at least two fuel vapor storage canisters based on the exhaust gas air-fuel ratio measured while individually purging each of the at least two fuel vapor storage canisters, the controller includes further computer-readable instructions stored on the non-transitory memory that, when executed, cause the controller to: determine the working capacity in proportion to a richness of the exhaust gas air-fuel ratio in response to the exhaust gas air-fuel ratio shifting rich during the purging, and indicate degradation of the working capacity in response to the exhaust gas air-fuel ratio not shifting rich during the purging.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

in response to greater than a threshold change in a fuel level of a fuel tank fluidically coupled to at least two fuel vapor storage canisters of an evaporative emissions control system during a refueling event, performing a canister working capacity diagnostic on each of the at least two fuel vapor storage canisters by measuring an exhaust gas air-fuel ratio (AFR) while independently purging each of the at least two fuel vapor storage canisters.

2. The method of claim 1, wherein performing the canister working capacity diagnostic on each of the at least two fuel vapor storage canisters by measuring the exhaust gas AFR while independently purging each of the at least two fuel vapor storage canisters comprises:

selecting one of the at least two fuel vapor storage canisters to purge;

indicating degradation of a working capacity of the selected one of the at least two fuel vapor storage canisters in response to the exhaust gas AFR shifting lean during the purging; and determining the working capacity of the selected one of the at least two fuel vapor storage canisters in response to the exhaust gas AFR shifting rich during the purging, wherein the working capacity is proportional to a richness of the exhaust gas AFR.

3. The method of claim 2, wherein independently purging each of the at least two fuel vapor storage canisters comprises:

opening or maintaining open a first canister vent valve (CVV) coupled between a first vent port of the selected one of the at least two fuel vapor storage canisters and a vent line; and closing or maintaining closed a CVV coupled between a vent port of each of the at least two fuel vapor storage canisters that is not the selected one of the at least two fuel vapor storage canisters and the vent line.

4. The method of claim 3, wherein independently purging each of the at least two fuel vapor storage canisters further comprises:

adjusting a balance valve coupled between the fuel tank and a branched loading passage configured to flow fuel vapors from the fuel tank to each of the at least two fuel vapor storage canisters to a first position where the fuel tank is fluidically coupled to the selected one of the at least two fuel vapor storage canisters and not fluidically coupled to each of the at least two fuel vapor storage canisters that is not the selected one of the at least two fuel vapor storage canisters; and opening a canister purge valve (CPV) positioned in a branched purge passage that fluidically couples an engine intake to a purge port of each of the at least two fuel vapor storage canisters.

5. The method of claim 4, further comprising:

preventing vapor flow across the selected one of the at least two fuel vapor storage canisters in response to the degradation of the working capacity of the selected one of the at least two fuel vapor storage canisters being indicated.

6. The method of claim 5, wherein preventing the vapor flow across the selected one of the at least two fuel vapor storage canisters comprises:

maintaining the first CVV closed; and blocking flow between the fuel tank and the selected one of the at least two fuel vapor storage canisters via the balance valve.

7. The method of claim 2, further comprising:

reducing a refueling capacity of the fuel tank in response to the degradation of the working capacity of the selected one of the at least two fuel vapor storage canisters being indicated.

8. The method of claim 1, wherein the threshold change in the fuel level comprises going from an initial fuel level in the fuel tank that is less than a lower threshold fuel level to a final fuel level that is greater than an upper threshold fuel level during the refueling event, wherein the lower threshold fuel level is less than 25% of a total capacity of the fuel tank and the upper threshold fuel level is more than 75% of the total capacity of the fuel tank.

9. The method of claim 8, wherein the lower threshold fuel level is in a first range from 0-10% of the total capacity of the fuel tank and the upper threshold fuel level is in a second range from 90-100% of the total capacity of the fuel tank.

10. The method of claim 1, wherein performing the canister working capacity diagnostic on each of the at least two fuel vapor storage canisters is further in response to a successful leak test of the evaporative emissions control system having been performed within a threshold duration.

11. A method, comprising:

separately diagnosing a working capacity of each of a first fuel vapor storage canister and a second fuel vapor storage canister of an evaporative emissions control system of a vehicle based on an exhaust gas air-fuel ratio measured while purging one of the first fuel vapor storage canister and the second fuel vapor storage canister and sealing the other of the first fuel vapor storage canister and the second fuel vapor storage canister.

12. The method of claim 11, wherein the evaporative emissions control system comprises a first canister vent valve (CVV) coupled between a first vent port of the first fuel vapor storage canister and a vent line to atmosphere, a second CVV coupled between a second vent port of the second fuel vapor storage canister, and a balance valve configured to fluidically couple one or both of the first fuel vapor storage canister and the second fuel vapor storage canister to a fuel tank of the vehicle, and wherein purging the one of the first fuel vapor storage canister and the second fuel vapor storage canister while sealing the other of the first fuel vapor storage canister and the second fuel vapor storage canister comprises:

sealing the second fuel vapor storage canister by closing the second CVV and adjusting the balance valve to a first position that fluidically couples the first fuel vapor storage canister to the fuel tank and blocks flow between the second fuel vapor storage canister and the fuel tank; and purging the first fuel vapor storage canister while the second fuel vapor storage canister is sealed by opening or maintaining open the first CVV and opening a canister purge valve (CPV) positioned in a branched purge line fluidically coupling an engine intake to a purge port of each of the first fuel vapor storage canister and the second fuel vapor storage canister.

13. The method of claim 12, wherein purging the one of the first fuel vapor storage canister and the second fuel vapor storage canister while sealing the other of the first fuel vapor storage canister and the second fuel vapor storage canister further comprises:

sealing the first fuel vapor storage canister by closing the first CVV and adjusting the balance valve to a second position that fluidically couples the second fuel vapor storage canister to the fuel tank and blocks flow between the first fuel vapor storage canister and the fuel tank; and purging the second fuel vapor storage canister while the first fuel vapor storage canister is sealed by opening or maintaining open the second CVV and opening the CPV.

14. The method of claim 11, wherein separately diagnosing the working capacity of each of the first fuel vapor storage canister and the second fuel vapor storage canister of the evaporative emissions control system of the vehicle based on the exhaust gas air-fuel ratio measured while purging the one of the first fuel vapor storage canister and the second fuel vapor storage canister and sealing the other of the first fuel vapor storage canister and the second fuel vapor storage canister comprises:

indicating degradation of the working capacity of the one of the first fuel vapor storage canister and the second fuel vapor storage canister in response to the exhaust gas air-fuel ratio shifting lean upon purging the one of the first fuel vapor storage canister and the second fuel vapor storage canister; and determining the working capacity of the one of the first fuel vapor storage canister and the second fuel vapor storage canister in proportion to a magnitude of the exhaust gas air-fuel ratio in response to the exhaust gas air-fuel ratio shifting rich upon purging the one of the first fuel vapor storage canister and the second fuel vapor storage canister.

15. The method of claim 14, further comprising:

in response to the degradation of the working capacity of one of the first fuel vapor storage canister and the second fuel vapor storage canister:

maintaining the one of the first fuel vapor storage canister and the second fuel vapor storage canister sealed; and reducing a maximum refueling capacity of a fuel tank of the vehicle by half.

16. A system, comprising:

a fuel tank coupled to at least two fuel vapor storage canisters via a branched loading passage;

a balance valve arranged at a branch point of the branched loading passage; and a controller with computer-readable instructions stored on non-transitory memory that, when executed, cause the controller to:

determine a working capacity of each of the at least two fuel vapor storage canisters following a refueling event of the fuel tank; and prevent vapor flow across one of the at least two fuel vapor storage canisters in response to the working capacity of the one of the at least two fuel vapor storage canisters being degraded.

17. The system of claim 16, wherein to determine the working capacity of each of the at least two fuel vapor storage canisters following the refueling event of the fuel tank, the controller includes further computer-readable instructions stored on the non-transitory memory that, when executed, cause the controller to:

individually purge each of the at least two fuel vapor storage canisters following the refueling event; and determine the working capacity of each of the at least two fuel vapor storage canisters based on an exhaust gas air-fuel ratio measured while individually purging each of the at least two fuel vapor storage canisters.

18. The system of claim 17, further comprising:

a branched vent line to atmosphere;

a first canister vent valve (CVV) disposed in a first branch of the branched vent line, the first branch coupled to a first of the at least two fuel vapor storage canisters;

a second CVV disposed in a second branch of the branched vent line, the second branch coupled to a second of the at least two fuel vapor storage canisters;

a branched purge line fluidically coupling each of the at least two fuel vapor storage canisters to an engine intake;

a canister purge valve (CPV) positioned in the branched purge line downstream of a branch point of the branched purge line; and wherein to individually purge each of the at least two fuel vapor storage canisters following the refueling event, the controller includes further computer-readable instructions stored on the non-transitory memory that, when executed, cause the controller to:

operate with the first CVV open, the second CVV closed, the CPV open, and the balance valve in a first position wherein only the first of the at least two fuel vapor storage canisters is fluidically coupled to the fuel tank to individually purge the first of the at least two fuel vapor storage canisters; and operate with the first CVV closed, the second CVV open, the CPV open, and the balance valve in a second position wherein only the second of the at least two fuel vapor storage canisters is fluidically coupled to the fuel tank to individually purge the second of the at least two fuel vapor storage canisters.

19. The system of claim 18, wherein to prevent vapor flow across one of the at least two fuel vapor storage canisters in response to the working capacity of the one of the at least two fuel vapor storage canisters being degraded, the controller includes further computer-readable instructions stored on the non-transitory memory that, when executed, cause the controller to:

maintain the first CVV closed and not adjust the balance valve to the first position or a third position wherein each of the at least two fuel vapor storage canisters are fluidically coupled to the fuel tank in response to the first of the at least two fuel vapor storage canisters being degraded; and maintain the second CVV closed and not adjust the balance valve to the second position or the third position in response to the second of the at least two fuel vapor storage canisters being degraded.

20. The system of claim 17, wherein to determine the working capacity of each of the at least two fuel vapor storage canisters based on the exhaust gas air-fuel ratio measured while individually purging each of the at least two fuel vapor storage canisters, the controller includes further computer-readable instructions stored on the non-transitory memory that, when executed, cause the controller to:

determine the working capacity in proportion to a richness of the exhaust gas air-fuel ratio in response to the exhaust gas air-fuel ratio shifting rich during the purging; and indicate degradation of the working capacity in response to the exhaust gas air-fuel ratio not shifting rich during the purging.

* * * * *